US010012471B1

(12) United States Patent
Warren

(10) Patent No.: US 10,012,471 B1
(45) Date of Patent: Jul. 3, 2018

(54) REAR SIGHT WITH VARIABLE NOTCH SETTINGS

(71) Applicant: Scott M. Warren, Montclair, VA (US)

(72) Inventor: Scott M. Warren, Montclair, VA (US)

( * ) Notice: Subject to any disclaimer, the term of this patent is extended or adjusted under 35 U.S.C. 154(b) by 19 days.

(21) Appl. No.: 15/173,128

(22) Filed: Jun. 3, 2016

Related U.S. Application Data

(60) Provisional application No. 62/170,508, filed on Jun. 3, 2015, provisional application No. 62/279,392, filed on Jan. 15, 2016.

(51) Int. Cl.
*F41G 1/17* (2006.01)
*F41G 1/10* (2006.01)

(52) U.S. Cl.
CPC *F41G 1/17* (2013.01); *F41G 1/10* (2013.01)

(58) Field of Classification Search
CPC ..... F41G 1/00; F41G 1/06; F41G 1/16; F41G 1/17; F41G 1/08
USPC ..... 42/140, 133
See application file for complete search history.

(56) References Cited

U.S. PATENT DOCUMENTS 688,194 A * 12/1901 Orge ..... F41G 1/17 42/140
1,027,891 A * 5/1912 Peck, Jr. ..... F41G 1/26 42/137
1,433,422 A * 10/1922 Spencer ..... F41G 1/02 42/140
1,450,823 A * 4/1923 Spencer ..... F41G 1/02 42/136
1,466,913 A * 9/1923 Matthews ..... F41G 1/17 42/140
1,586,413 A * 5/1926 Doornbos ..... F41G 1/17 42/140
2,603,874 A * 7/1952 Stewart ..... F41G 1/033 42/140
4,691,442 A * 9/1987 Center ..... F41G 1/17 42/135
6,615,530 B2 * 9/2003 Johansson ..... F41G 1/17 42/133
7,726,229 B2 * 6/2010 Schwerman ..... F41G 1/17 42/125
8,069,607 B2 * 12/2011 Ballard ..... F41G 1/033 42/111

* cited by examiner

*Primary Examiner* — Jonathan C Weber
(74) *Attorney, Agent, or Firm* — Gilberto M. Villacorta; Kiri Sharon; Foley & Lardner LLP

(57) ABSTRACT

A rear sight is provided for use on a firearm. The rear sight includes a rear sight blade connected to a mounting base. The mounting base is configured to be connected to a top surface of the firearm. The blade includes a sighting notch positioned to be aligned with a post on a front sight. The width of the sighting notch is variable. The rear sight is configured to be provided with a second sighting notch integrated within the rear sight and which is configured to move between a first position and a second position.

14 Claims, 27 Drawing Sheets

REAR SIGHT WITH VARIABLE NOTCH SETTINGS

CROSS-REFERENCE TO RELATED APPLICATIONS

The present application claims the benefit of the priority date of U.S. Provisional Patent Application Ser. No. 62/170,508 filed on Jun. 3, 2015 and the priority date of U.S. Provisional Patent No. 62/279,392 filed on Jan. 15, 2016, the contents of which are hereby incorporated by reference in their entirety.

BACKGROUND

The present application relates to the field of sights for firearms. More specifically, the present application relates to a rear sight for a firearm having a variable sight width.

A simple sighting mechanism for a firearm typically includes a front sight near the muzzle and a rear sight near the hammer or striker and shooter. When shooting, the front sight and the rear sight are aligned such that the positive shape of the body of the front sight is positioned within the negative space of a notch in the rear sight. When the front sight is centered relative to the rear sight, there is an equal amount of light, referred to as "light bars" on either side of the front sight as viewed through the notch in the rear sight. The width of the rear sight notch can affect the amount of light seen by the shooter.

With law enforcement training, competitive action shooting or self-defense training, when learning to shoot, an individual must learn to shoot accurately and then quickly. A narrow notch greatly aids or assists with learning to shoot accurately. Then once the individual can shoot accurately, they learn to shoot more quickly. A wide notch greatly aids or assists with this. Due to differences in personal preferences, shooting styles and techniques, for different users, the same rear sight design may be manufactured with a variety of rear sight aperture dimensions and/or designs.

Since the rear notch is machined/cut into the metal sight it cannot be quickly modified or changed. It can be machined to a larger size, but not to a smaller size. Modifying or changing a notch size involves securing it in a vice or a milling machine and then cutting metal away to increase the size of the opening. The sight then has to be refinished, blued and then reinstalled. To reduce the size of the rear notch would be even more time consuming and would involve removing the sight, filling the notch with a metal insert, welding the metal insert in place, machining the metal insert to match the sight's surface and then machining a smaller notch size Another disadvantage of removing and reinstalling sights is the accumulative wearing of the fitted parts. Each time this is done, it alters the mating surfaces of the parts. This wearing out of fitted parts is not desirable. A sight that does not fit securely will move or "walk" each time the handgun is shot. This will result in inaccurate shot placement.

The problem of only having one size rear sight notch is an issue for both fixed and adjustable rear sights. The width and/or depth of the rear sight notch cannot easily be changed when training, cannot easily be changed when practicing engaging small targets or when engaging distance targets, and cannot be changed when going from day light to night time for carry.

SUMMARY

One disclosed embodiment relates to a rear sight for use on a firearm. The rear sight includes a rear sight blade connected to a mounting base. The mounting base is configured to be connected to a top surface of the firearm. The blade includes a sighting notch positioned to be aligned with a post on a front sight. The width of the sighting notch is variable, and may be selected by the shooter.

Another disclosed embodiment relates to including a fixed front sight including a post and a rear sight located closer to the user than the front sight. The rear sight includes a rear sight notch. The sights are positioned so that when aiming the firearm the user can align the firearm so that from the perspective of the user, the post is positioned within the rear sight notch. The width of the rear sight notch is variable.

Yet another disclosed embodiment relates to a method of varying a width of a sighting notch, which comprises a rear sight of a handgun. The method includes selecting a desired width of a sighting notch, which comprises a rear sight of a handgun. The method further includes rotating a disc integrated into the rear sight and having a plurality of sighting notches to expose a sighting notch having the desired width or refraining from rotating the disc if the sighting notch having the desired width is already exposed.

Yet another embodiment is a rear sight for a firearm, the rear sight comprising (a) a rear sight blade connected to a mounting base, which is configured to be mounted on a top surface of the firearm, wherein the rear sight blade includes a first sighting notch; and (b) a second sighting notch that is integrated within the rear sight and which is configured to move between a first position and a second position, such first sighting notch being an effective sighting notch of the rear sight when the second sighting notch is in the first position and such second sighting notch being the effective sighting notch of the rear sight when the second sighting notch is in the second position.

Yet another embodiment is a firearm comprising a fixed front sight with a post and a rear sight which is located closer to the user of the firearm than the front sight, the rear sight comprising: (a) a rear sight blade connected to a mounting base, which is configured to be mounted on a top surface of the firearm, wherein the rear sight blade includes a first sighting notch; and (b) a second sighting notch that is integrated within the rear sight and which is configured to move between a first position and a second position such first sighting notch being an effective sighting notch of the rear sight when the second sighting notch is in the first position and such second sighting notch being the effective sighting notch of the rear sight when the second sighting notch is in the second position.

Yet another embodiment is a method of varying a sighting notch on a rear sight of a firearm, in which (a) a rear sight blade is connected to a mounting base, which is configured to be mounted on a top surface of the firearm, wherein the rear sight blade includes a first sighting notch; and (b) a second sighting notch that is integrated within the rear sight and which is configured to move between a first position and a second position such first sighting notch being an effective sighting notch of the rear sight when the second sighting notch is in the first position and such second sighting notch being the effective sighting notch of the rear sight when the second sighting notch is in the second position, the method comprising: (A) selecting a desired sighting notch from the first sighting notch and the second sighting notch of the rear sight mounted on the firearm and (B) positioning the second sighting notch in the first position or in the second position.

It is to be understood that both the foregoing general description and the following detailed description are exemplary and explanatory only, and are not restrictive of the invention as claimed.

BRIEF DESCRIPTION OF THE DRAWINGS

Features, aspects, and advantages of the present invention will become apparent from the following description, appended claims, and the accompanying exemplary embodiments shown in the drawings, which are briefly described below.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and made part of this disclosure.

The rear sight described below includes a mechanism for varying the width of the rear sighting notch. For the new or experienced shooter, for law enforcement personnel, for competitive shooting sports and/or when training for personal/home defense situations, the adjustable width of the rear sighting notch allows the shooter to select the notch size that best provides the desired sight picture for the targets/threats that are evident or anticipated (day or night). Depending on the training, targets available and/or shooting situation, a notch can be selected that the individual best feels will help them to successfully engage the targets/threats.

Figure 1:
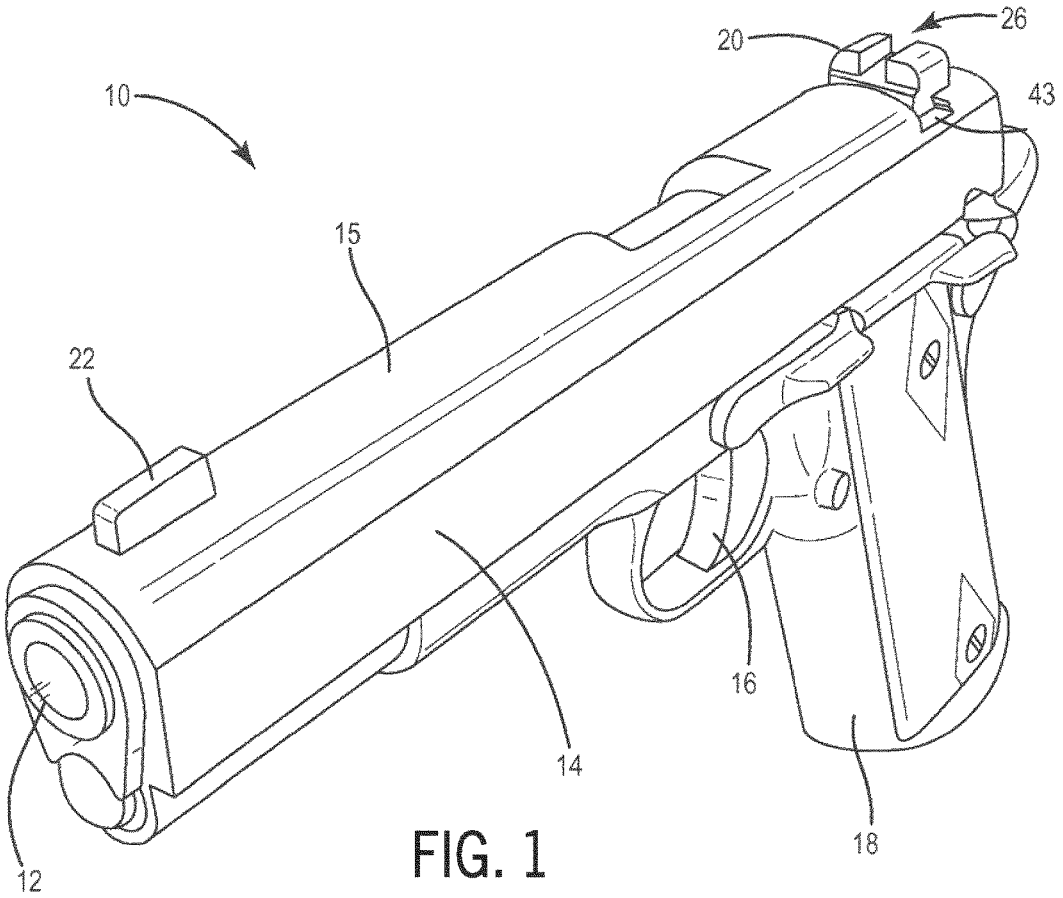
FIG. 1 is a front perspective view of a pistol, according to an exemplary embodiment.

Referring to FIG. 1, a firearm 10, shown as a semiautomatic pistol, includes a barrel 12, a chamber configured to receive a round and in communication with the barrel, and a trigger 16 configured to activate a firing mechanism when pulled. The firearm 10 further includes a slide 14 which ejects a spent round from the chamber after the firearm 10 is fired, readies the firing mechanism for another shot, and loads another round into the chamber. The trigger 16 is disposed below the barrel 12. The firearm 10 further includes a handle 18 that is configured to be gripped by the hand of a user of the firearm 10. The handle 18 projects downward from the barrel 12. The handle 18 may be a generally hollow body configured to receive a magazine containing additional rounds through an opening in the distal end of the handle 18.

The firearm 10 further includes a sighting mechanism to aid the shooter in aiming the firearm 10. The sighting mechanism includes a rear sight 20 and a front sight 22. The rear sight 20 and the front sight 22 are disposed on an upper surface 15 of the slide 14. The front sight 22 is generally disposed towards the front of the slide (e.g., proximate the muzzle of the firearm 10). The rear sight 20 is generally disposed towards the rear of the slide, closer to the user than the front sight 22.

Figure 2A:
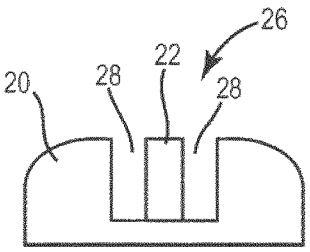
FIGS. 2A, 2B, and 2C are rear views of the sighting mechanism of the pistol of FIG. 1, according to an exemplary embodiment.
Figure 2B:
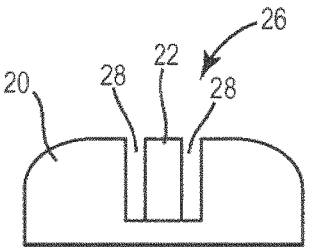
Figure 2C:
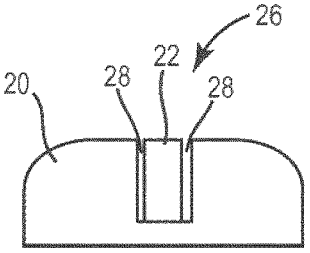
Figure 3:
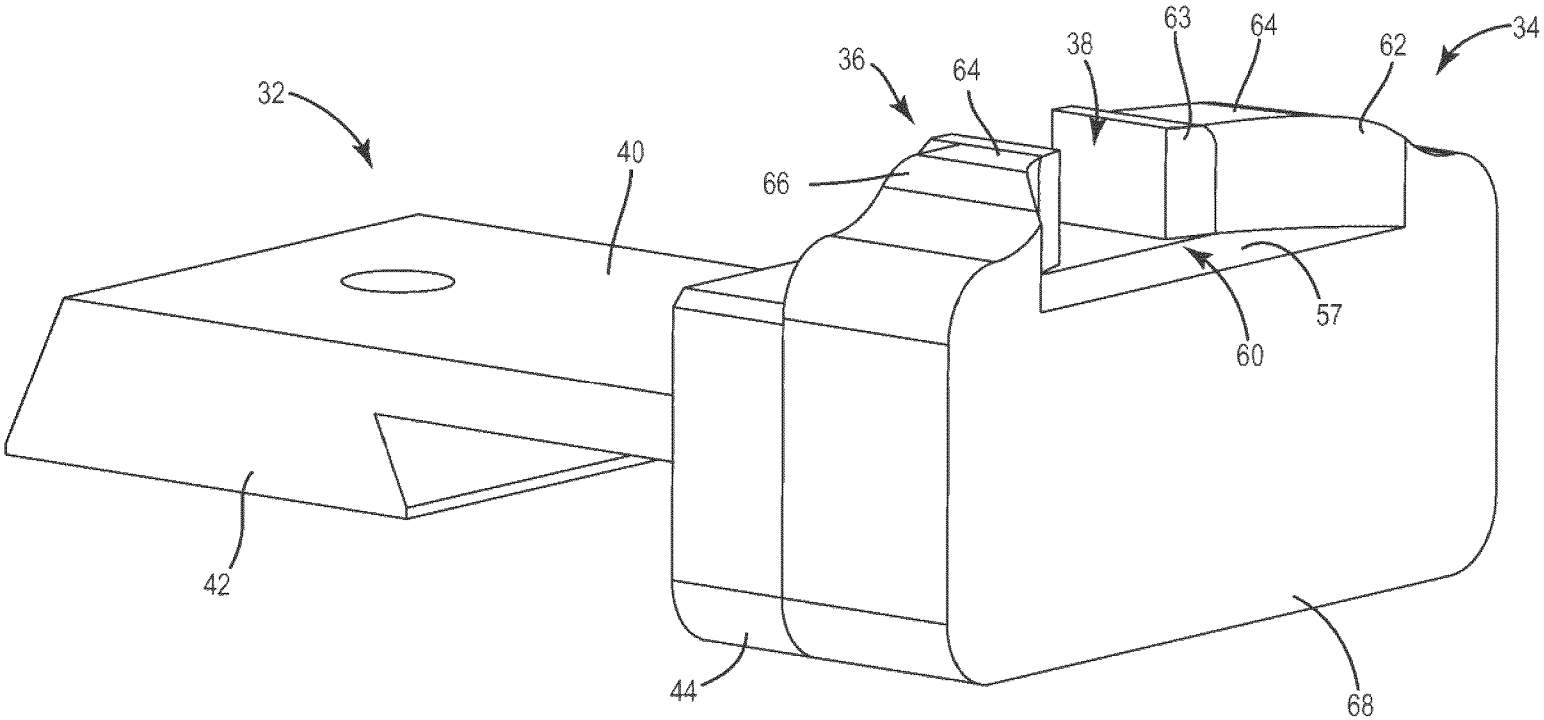
FIG. 3 is a perspective view of a rear sight for a pistol, according to an exemplary embodiment.
Figure 4:
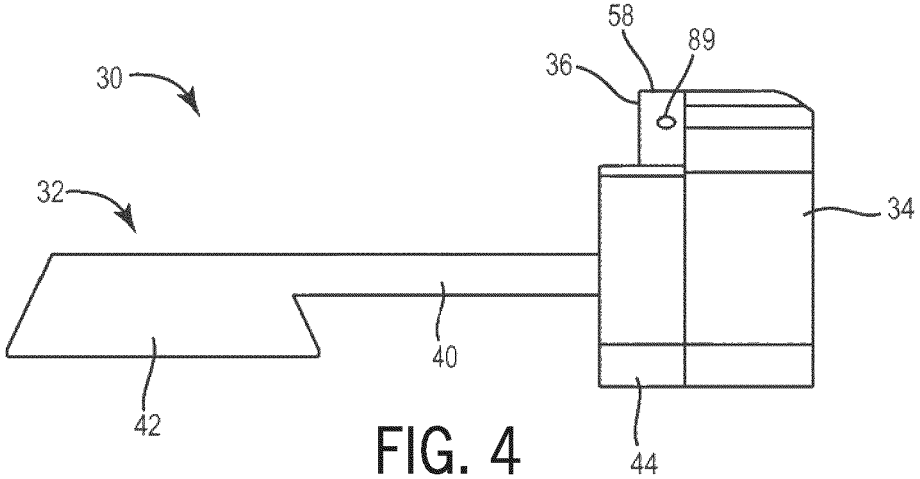
FIG. 4 is a side view of the rear sight of FIG. 3.
Figure 5:
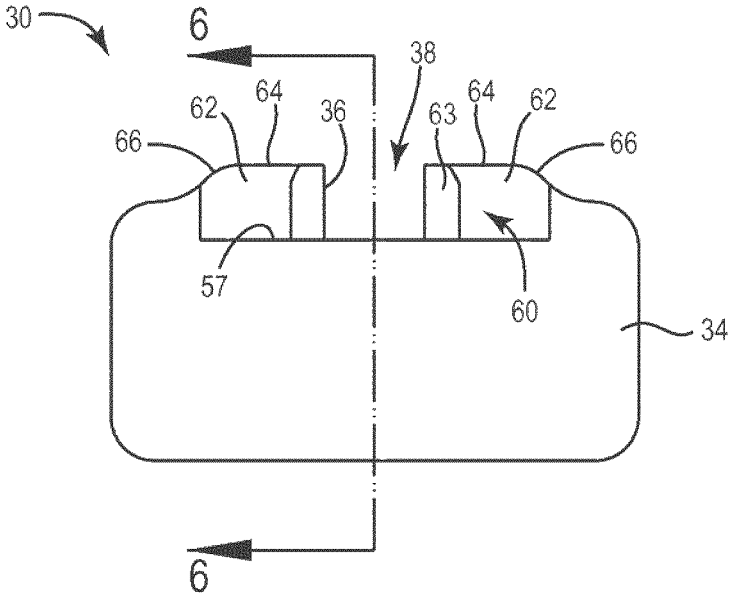
FIG. 5 is a rear view of the rear sight of FIG. 3.

The front sight 22 includes an upwardly extending body (e.g., post, pin, ball, bar, etc.) while the rear sight 20 defines an aperture 26 (e.g., space, notch, hole, gap, etc.). As shown in FIGS. 2A-2C, when shooting, the sights 20 and 22 are aligned such that the positive shape of the body of the front sight 22 is positioned within the negative space of the aperture 26. The shooter holds the firearm 10 so that the front sight 22 and the rear sight 20 are aligned both vertically (e.g., with the top edge of the front sight 22 level with the top edge of the rear sight 20) and horizontally (e.g., with the front sight 22 centered within the rear sight 20). When the front sight 22 is centered relative to the rear sight 20, there is an equal amount of light, referred to as "light bars 28" on either side of the front sight 22 as viewed through the aperture 26.

A user may choose sights for a firearm having desired dimensions. For example, the user may choose a desired height and width of the front sight 22 and an overall height of the rear sight 20, as well as width and depth of the aperture 26. The depth of the aperture 26 is typically as deep as possible, as long as the shooter cannot see the top of the slide 14, as the slide 14 can become a visual distraction when visible through the aperture 26. Typically, the aperture 26 has a depth such that the front sight 22 is the only part of the firearm 10 that is visible to the shooter. The width of the aperture 26 may vary based on the tastes of the shooter.

Referring to FIG. 2A, a wide aperture 26 in combination with a relatively narrow front sight 22, allows the front sight 22 to be more easily seen. A wide aperture 26 provides ample light bars 28 on either side of the front sight 22, which allow the shooter to more quickly visually verify that the front sight 22 is aligned and on target. With a wide aperture 26, the shooter sees more of the target as they look through the sight picture. This is advantageous or a benefit for engaging threats/target at a close distance (e.g., between 1 and 10 yards).

Referring to FIG. 2B, to accurately engage targets at midrange distances (e.g., between 11 and 25 yards), or to accurately engage small partial targets or small steel targets, a narrow aperture 26 may be desirable. A narrower aperture 26 results in a smaller light bar 28 on either side of the front sight 22, which may aid the shooter in shooting accurately at midrange distances. The small slight bars 28 may cause the shooter to slow down and hold the firearm 10 steadier to ensure that the front sight 22 does not move when the trigger 16 is being pressed.

Referring to FIG. 2C, to accurately engage extremely small targets or targets at long distances (e.g., between 26 and 50 yards), an even narrower notch may be desirable. An even narrower aperture 26 used with a front sight with a similar width allows for very narrow light bars 28 to be seen around the front sight 22. This tight sight picture results in very little margin for error in front sight movement, resulting in potentially more accurate target engagement/shot placement.

Referring now to FIGS. 3-9, a rear sight 30 is shown according to an exemplary embodiment with a variable component capable of providing an aperture of various widths. According to an exemplary embodiment, the rear sight 30 includes a mounting base 32 configured to be coupled to upper surface 15 of the slide 14, a rear sight blade 34 coupled to the mounting base 32, and a disk 36 (e.g., rotor, dial, etc.) that is coupled to the rear sight blade 34 and is rotatable relative to the mounting base 32 and the rear sight blade 34. The disk 36 includes multiple notches 38 of various dimensions. The disk 36 may be rotated relative to the mounting base 32 and the rear sight blade 34 to align a notch 38 of desired dimensions with a front sight.

The mounting base 32 includes an arm 40, a coupling member 42 configured to couple the arm 40 to the firearm 10 or other body, and a blade supporting member 44 coupled to the arm 40. In some embodiments, the rear sight 30 may be a fixed position sight. That is, the mounting base 32 may be configured as a static member such that the position of the rear sight blade 34 and the position of the disk 36 relative to the firearm are fixed. The mounting base 32 may be mounted to the slide 14 with a dovetail joint. The coupling member 42 is a downwardly extending boss with a trapezoidal cross-sectional shape. The coupling member 42 is configured to engaged (e.g., slide into) a corresponding trapezoidal slot 43 machined or otherwise formed in the slide 14. The slot 43 may be an existing, standard slot used for mounting a conventional sight to a firearm. In other embodiments, the mounting base 32 may be coupled to another stationary member, such as an existing fixed rear sight.

In another embodiment, the mounting base 32 may be moveable relative to the upper surface 15 of the firearm 10 so that the vertical position of the rear sight blade 34 and the disk 36 can be varied. The mounting base 32 may be configured such that the horizontal position of the rear sight blade 34 and the disk 36 can be varied. When it is used on an existing adjustable sight, the mounting base 32 may be attached to the existing sight's adjustable arm that moves up/down and left/right. For example, the mounting base 32 may be coupled to, integrated with, or similar in construction and function to a known adjustable rear sight, such as a BoMar adjustable rear sight, marketed by Kensight®.

The blade supporting member 44 provides a structure to which the rear sight blade 34 and the disk 36 are mounted. According to an exemplary embodiment, the rear sight blade 34 is coupled to the blade supporting member 44 with threaded fasteners 46 that pass through through-holes 48 in the blade supporting member 44 and engage threaded holes 49 (see FIG. 9) in the rear sight blade 34. The removable nature of the threaded fasteners 46 allows the rear sight blade 34 and the disk 36 to be removed from the mounting base 32, for example, to service the internal components of the rear sight 30, to replace the disk 36 with a differently configured disk, etc. However, in other embodiments, the rear sight blade 34 may be coupled to the blade supporting member 44 with any suitable coupling mechanism, including welding, rivets, adhesives, etc.

The inside surface 51 of the blade supporting member 44 defines a recess 50 (e.g., cut, hollow, void, etc.) that is configured to receive the disk 36. The recess 50 is formed such that it opens to an upper surface 53 of the blade supporting member 44. When positioned in the recess 50, an upper portion of the disk 36 including one of the notches 38 extends above the upper surface 53 of the blade supporting member 44. In one embodiment, the recess 50 has a depth that is less than the thickness of the disk 36 such that only the front portion of the disk 36 is disposed within the recess 50 while the rear portion of the disk 36 extends beyond the inside surface 51 of the blade supporting member 44.

The inside surface 55 of the rear sight blade 34 defines a recess 54 (e.g., cut, hollow, void, etc.) that is configured to receive the disk 36. The recess 54 is formed such that it opens to an upper surface 57 of the rear sight blade 34. When positioned in the recess 54, an upper portion of the disk 36 including one of the notches 38 extends above the upper surface 57 of the rear sight blade 34. In one embodiment, the recess 54 has a depth that is less than the thickness of the disk 36 such that only the rear portion of the disk 36 is disposed within the recess 54 while the front portion of the disk 36 extends beyond the inside surface 55 of the rear sight blade 34. Together, the recesses 50 and 54 form the cavity in which the disk 36 is disposed when the rear sight blade 34 is coupled to the blade supporting member 44. According to an exemplary embodiment, the recess 50 and the recess 54 have similar depths (e.g., approximately ½ the thickness of the disk 36. In other embodiments, the recess 50 or the recess 54 may be absent and the disk may be disposed in a cavity formed by a recess formed entirely in either the rear sight blade 34 or the blade supporting member 44.

The disk 36 is a notched member configured to move (e.g., rotate) relative to the rear sight blade 34. The disk 36 defines multiple notches 38. The disk 36 can be rotated relative to the mounting base 32 and the rear sight blade 34 such that only one of the notches 38 is visible at a time to the user of the firearm 10. According to one exemplary embodiment, the disk 36 defines three rectangular notches 38, each of which extends inward from a curved outer surface 58. The notches 54 are positioned at regular intervals about the circumference of the disk 36. The notches 38 may be configured differently, such as with different dimensions (e.g., widths, depths) and/or different shapes to allow the user of the firearm to select a desired aperture through which to view the front sight when aiming. In one exemplary embodiment, the notches 38 each have the same shape and depth but vary in width. In other embodiments, the notches 38 may have varied depths and/or shapes instead of or in addition to varied widths. For example, in other embodiments, one or more of the notches may be differently shaped (e.g., triangular, circular, trapezoidal, etc.). In another embodiment, the notches may have different depths (e.g., the distance between the base of the notch and the outer circumference of the disk). For example, the notches may each have bases that are different distances from the rotational axis of the disk or the disk may be truncated at different distances from the rotational axis of the disk at each of the notches. The number of notches 38 may vary based on the dimensions of the disk 36 and the dimensions of the notches 38. While the disk 36 shown and described herein forms three notches 38, in other embodiments, the rear sight 30 may include a disk having only two notches or more than three notches.

The rear sight blade 34 defines a window 60 (e.g., blade notch) through which a selected notch 38 of the disk 36 may be viewed. According to an exemplary embodiment, the window 60 is defined by the upper surface 57 and a pair of inwardly curving side faces 62. The side faces 62 are formed by a pair of upwardly extending arms 64, each of which includes a curved upper surface 66. The window 60 has a width that is greater than the width of any of the notches 38 in the disk 36. The disk 36 is rotated until a selected notch 38 is visible above the upper surface 53 of the blade supporting member 44 and the upper surface 57 of the rear sight blade 34 and aligned with the window 60. Together, the notch 38 and the window 60 form a sighting notch through which the front sight may be viewed to aim the firearm.

With a traditional straight notch window, there are vertical lines that could be distracting to the shooter. The curved side faces 62 of the window 60 provide a "gentle or smooth" visual transition from a rear surface 68 of the rear sight blade 34 to the selected notch 38. The disk 36 may include a chamfer 63 on either side of the notch 38 such that the chamfer 63 and the curved face 62 present one continuous surface to the shooter to provides a smooth visual transition from the rear surface 68 through the selected notch 38 to the front sight and/or the target/threat.

Figure 7:
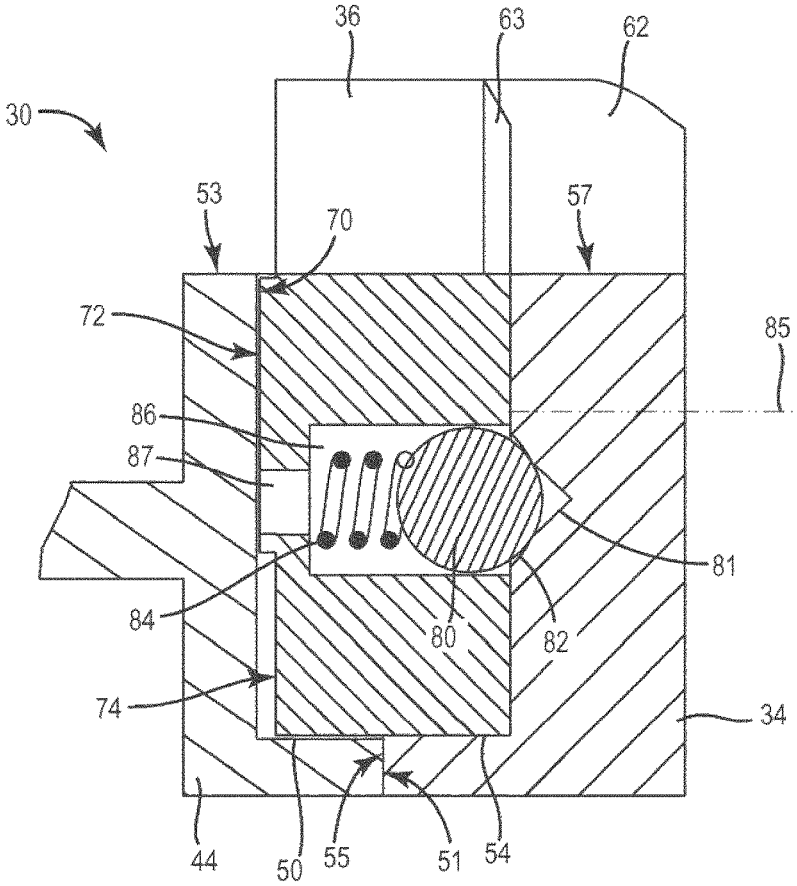
FIG. 7 is a detail cross-section view of the rear sight of FIG. 5.

Referring to FIG. 7, the disk 36 is biased toward the mounting base 32. The disk 36 contacts a surface 70 of the recess 50 in the blade supporting member 44 at a rotating contact surface 72 (e.g., bearing surface). The contact surface 72 is formed by a raised boss so that the entire front surface 74 of the disk 36 does not contact the surface 70. The contact surface 72 provides a sufficient contact area to maintain an even, unrestricted turning/rotation of the disk 36. Because the area of contact between the surfaces 70 and 72 is less than the area of the front surface 74, the frictional force resisting the rotation of the disk 36 relative to the mounting base 32 is reduced, allowing the disk 36 to rotate freely. This, in turn, reduces the tendency for the disk 36 "climb out" or "walk out" of the top of the recess 50 when rotating or to bind against the surface 70 of the blade supporting member 44. The outer edges of the disk 36 may be chamfered to further reduce contact area between the disk 36 and the mounting base 32 or rear sight blade 34 and facilitate the rotation of the disk 36.

The disk 36 is configured such that the rotation of the disk 36 is indexed at positions in which the notches 38 are at the top of the disk 36, exposed above the upper surfaces 53 and 57 and aligned with the window 60 (e.g., the vertical position, 12 o'clock position, etc.). The number of indexed positions and the rotational angle between those indexed locations corresponds with the number and spacing of the notches 38. According to an exemplary embodiment, the disk is configured to have three indexed positions, separated by 120 degrees of rotation of the disk 36.

Figure 6:
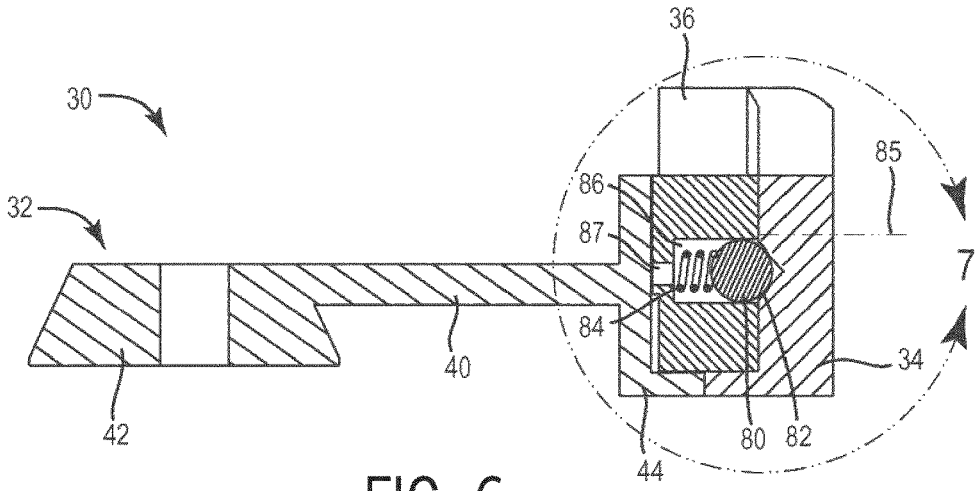
FIG. 6 is a cross-section view of the rear sight of FIG. 5, taken along line 6-6.

Referring to FIGS. 6-7, according to an exemplary embodiment, the rotation of the disk 36 is indexed with one or more biased members, shown as ball bearings 80, which engage features, shown as detents 82 in the rear sight blade 34. The ball bearing 80 is movable relative to the disk 36 and the rear sight blade 34 and is configured to be located in one of the detents 82 when the disk 36 is in an indexed position. The ball bearing 80 is biased away from the disk 36 and toward the blade 34 by a biasing member, shown as a coil spring 84. The coil springs 84 provide force biasing the ball bearings 80 towards the rear sight blade 34 and biasing the disk towards the mounting base 32.

In other exemplary embodiments, the indexing components may be arranged differently. For example, the components may be reversed in orientation such that the disk 36 is biased toward the blade 34. The detents or other indexing features may be formed in the recess 50 of the mounting base 32 and the coil springs 84 may provide a biasing force forcing the contact surface 72 of the disk 36 against the rear sight blade 34.

According to an exemplary embodiment, the rear sight 30 includes three biased members engaging three features. The multiple biased members and features help to maintain the disk 36 in the recesses 50 and 54 and rotating about the rotational axis 85. In other embodiments, the rear sight 30 may include any number of biased members and features. For example, according to another exemplary embodiment, the rear sight 30 may include a single biased member that engages multiple features as the disk 36 rotates about the rotational axis 85.

The ball bearings 80 are positioned relative to the disk 36 with positioning holes 86. The positioning holes 86 are hollows formed in the disk 36 and are each preferably spaced radially about the rotational axis of the disk 36. The coil springs 84 are disposed within the positioning holes 86 and the ball bearings 80 are disposed in the positioning holes 86 such that the coil springs 84 are compressed within the positioning holes 86. The positioning holes 86 have a diameter that is slightly larger than the diameter of the ball bearings 80, resulting in a very close tolerance between the walls of the positioning holes 86 and the ball bearings 80. Air bleed openings 87 may be provided in the base of the positioning holes 86 to allow air within the positioning holes 86 to escape as the ball bearings 80 are forced into the positioning holes. Further, the air bleed openings allow for a small tool to be inserted into the positioning holes 86, such as to push out a coil spring 84 or ball bearing 80 from the positioning hole 86. In other embodiments, the disk may be otherwise configured to allow air to escape the positioning holes 86, such as through slots or grooves formed in the walls of the positioning holes 86.

Detents 82 are formed in base of the recess 54 of the rear sight blade 34. The detents 82 are each preferably spaced radially about the rotational axis 85 of the disk 36 and are positioned such that, when the ball bearings 80 have engaged the detents 82, a notch 38 of the disk 36 is in the vertical position. The detents 82 are configured to accept, hold, or position the ball bearings 80. As shown in FIG. 7, in one exemplary embodiment, the detents 82 are formed as small diameter spherical holes with a conical base portion. For example, the detents 82 may be formed as spherical basins (e.g., bowl-shaped depressions) each with a diameter larger than the diameter of the ball bearings 80 and including a hole, shown as a conical hole 81, at the base of each depression in order to locate the ball bearing 80 within the depression. Thus, in this embodiment the ball bearing 80 is retained in position by resting on the circular rim of the base hole 81 (the depth of which may be configured in a non-conical shape) However, the detents may be formed as any hollow feature that receives a portion of the ball bearing 80. For example, the detents may be formed as conical holes or a cylindrical hole with a diameter that is less than the diameter of the ball bearings 80 such that the ball bearing 80 rest on the circumference or edge of the hole.

As the disk 36 rotates relative to the mounting base 32 and the rear sight blade 34, between indexed positions, the ball bearings 80 move out of the detents 82 and are forced into the positioning holes 86 by the rear sight blade 34. The ball bearings 80 compress the coil springs 84 as they are forced into the positioning holes 86. Any air in the positioning holes 86 behind the ball bearings 80 can escape through the air bleed openings 87. Once the disk 36 has been rotated sufficiently (e.g., such that another notch 38 is in the vertical position), the ball bearings 80 are each aligned with one of the detents 82. The coil springs 84 force the ball bearings 80 into the detents. This action secures, aligns and holds the disk 36 in the desired position with a notch 38 in the vertical position and aligned with the front sight.

Figure 9:
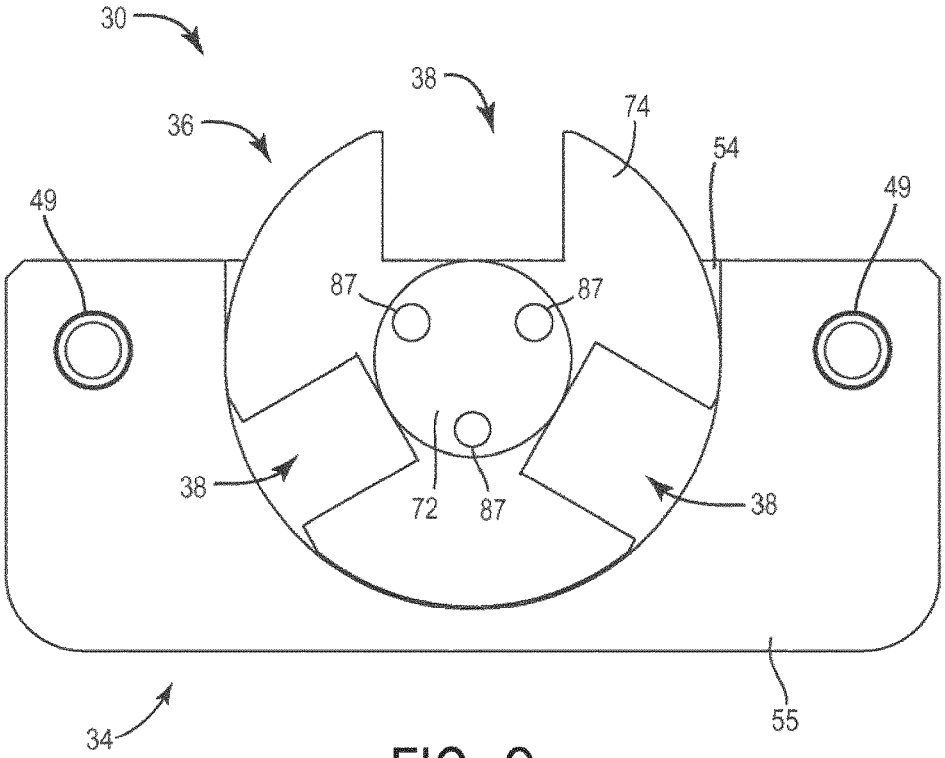
FIG. 9 is a front view of the rear sight of FIG. 3 with the mounting base removed.
Figure 10:
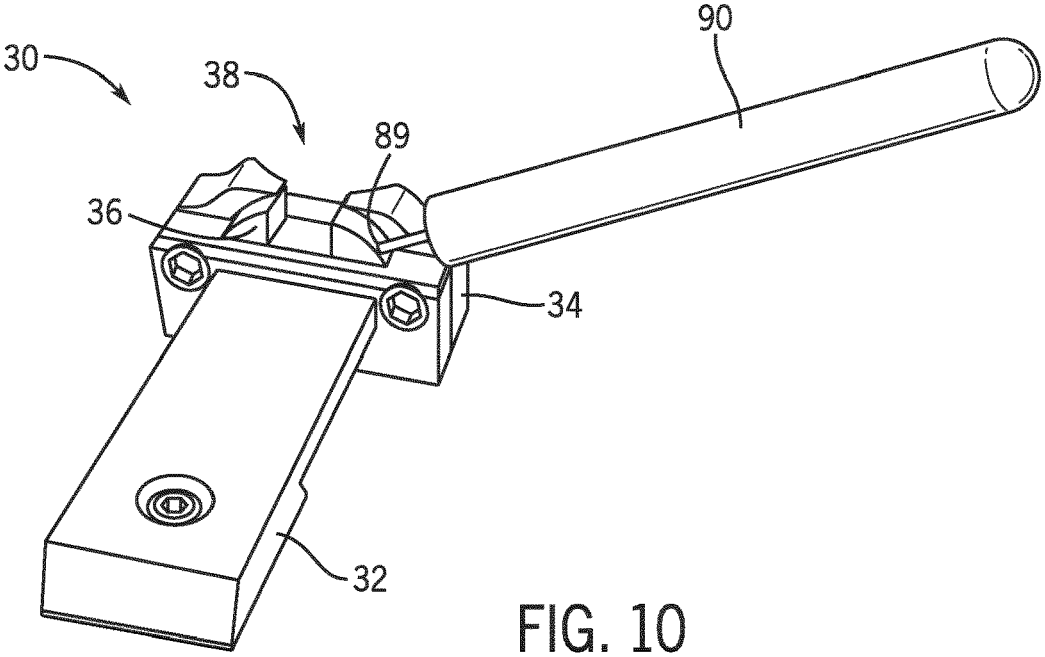
FIG. 10 is a perspective view of the rear sight of FIG. 3 showing a rotation tool, according to an exemplary embodiment.

Referring to FIG. 9, according to one exemplary embodiment, the disk 36 may be rotated with the aid of an additional tool. For example, one or more rotation holes 89 may be provided in the outer surface 58 of the disk 36. A tool 90 (e.g., rod, pin bar, etc.) may be inserted into the rotation hole 89. Once the tool 90 is inserted, slight pressure applied to the tool 90 causes the disk 36 to rotate. The use of the additional tool 90 can reduce the likelihood that the disk 36 will be knocked out of position by inadvertent contact such that a notch 38 of the disk 36 is no longer in the vertical position. In other embodiments, the disk may be rotated in other ways. For example, the outer surface 58 of the disk 36 may include features or surface texture (e.g., ribs, ridges, knurling, etc.) allowing a shooter to easily rotate the disk 36 without an additional tool.

According to an exemplary embodiment, the disk 36 of the rear sight 30 includes at least a narrow sighting notch, a medium sighting notch and a wide sighting notch. A narrow sighting notch may, for example, be selected for a distant target (i.e., 25 to 50 yards). In an exemplary embodiment, the narrow sighting notch has a width between 0.085 in. and 0.115 in. In a preferred embodiment, the narrow sighting notch has a width between 0.090 in. and 0.100 in. A medium sighting notch may, for example, be selected for an intermediate open or partial target (i.e., 10 to 25 yards). In an exemplary embodiment, the medium sighting notch has a width between 0.120 in and 0.140 in. In a preferred embodiment, the medium sighting notch has a width between 0.125 in. and 0.130 in. A wide sighting notch may, for example, be selected for a close open or partial target (i.e., 1 to 10 yards). In an exemplary embodiment, the wide sighting notch has a width between 0.140 in. and 0.170 in. In a preferred embodiment, the wide sighting notch has a width between 0.150 in. and 0.155 in.

The notches 38 of the disk 36 may be labeled to allow a shooter to easily select a desired sighting notch. For example, the outer surfaces 58 of the disk 36 may include labels (e.g., printed labels, engraved labels, etc.) indicating the size of the notch 38 in the vertical position. In other embodiments, the sizes of the notches 38 may be otherwise communicated to the shooter, such as with icons or colors.

The rear sight 30 as described herein allows a shooter to quickly and easily change the aspects of the rear sight sighting notch, including the width of the notch, the depth of the notch, and/or the shape of the notch.

The rear sight 30 may, for example, be used by a shooting student (e.g., a law enforcement officer, military personnel, recreational shooters, etc.). As the shooting student is learning and advancing in their skill development, having the ability to quickly change from one notch size to another during a training session expedites the training curve, reduces the training time and gives the shooter flexibility in learning to shoot and in training. As the shooter progresses, they can "dial up or down" the sight notch size to go along with their skills or the drills being shot. Further, depending on the shooter's own personal learning style, perception and personal shooting nuances, having the ability to quickly change from one notch size to another makes more efficient use of the training time and enhances the actual training received.

Once someone has learned to shoot, they can select a notch size that might potentially be beneficial to potential scenarios that might be presented. For example, a police officer that is working during the day light hours, might select a mid-size notch that allows for accuracy and quick sight alignment. That same officer, when working in the evening hours, might select a wide notch size that would allow for ample light, aiding in seeing the front sight. Additionally that same officer, working in normal day light conditions, where called upon to enter a building or potentially darken, poorly lite area, could quickly switch notch sizes from a mid-size notch to a wider notch. Even further, if that officer found that there were threats at far distances, that officer could switch to a narrower notch to aid in accurate target engagement.

The rear sight 30 may also be beneficial for a competitive shooter. In training, practicing or in match shooting, the shooter can face target arrays or stages of fire where different size rear notches would be beneficial for successful target engagement. A competitive shooter might have to shoot a course of fire/stage where the targets are close, 10 yards and under and have no vision barriers in front of them. In this scenario, a wide notch would be desired. The next stage, this same shooter might have to shoot a course of fire/stage with the partial targets, small metal plates or with targets at distances 25 to 50 yards. In this scenario, a narrow notch would be beneficial for successful target engagement. For competitive match shooting, it is not allowed to change pistols in the middle of a match. The same pistol must be used throughout the shooting competition. The competitor cannot change a sight in the middle of a match. With the use of the multi notch disc, the competitive shooter can quickly, safely and efficiently select the notch that best suits the course of fire that the shooter is facing.

The present application also provides a rear sight for a firearm, which may include a first sighting notch and a second sighting notch, which are both integrated within the rear sight. The rear sight may be configured to be mounted or installed on a top surface of the firearm. The second sighting notch may be configured to move between a first position and second position such that an effective sighting notch of the rear sight is the first sighting notch when the second sighting notch is in the first position and the second sighting notch when the second sighting notch is in the second position. The term "effective sighting notch" means a sighting notch that a user of the firearm would actually utilize for targeting the firearm by aligning that notch with a post of a front sight of the firearm. The first and the second sighting notch may have different widths. For example, a width of the second sighting notch may be narrower than a width of the first sighting notch. In some embodiments, a shape of the second sighting notch may be different from a shape of the first sighting notch.

In many embodiments, the second sighting notch may be positioned in front of the first sighting notch from the point of view of a user of the firearm. In such a case, when the second sighting notch is in the second position, it may be visible to the user through the first sighting notch and when the sighting notch is in the first position, it is not visible to the user through the first sighting notch.

In many embodiments, the first sighting notch may be a part of a rear sight blade, which may be connected to a mounting base, which may be configured to be mounted on a top surface of a firearm.

Figure 8:
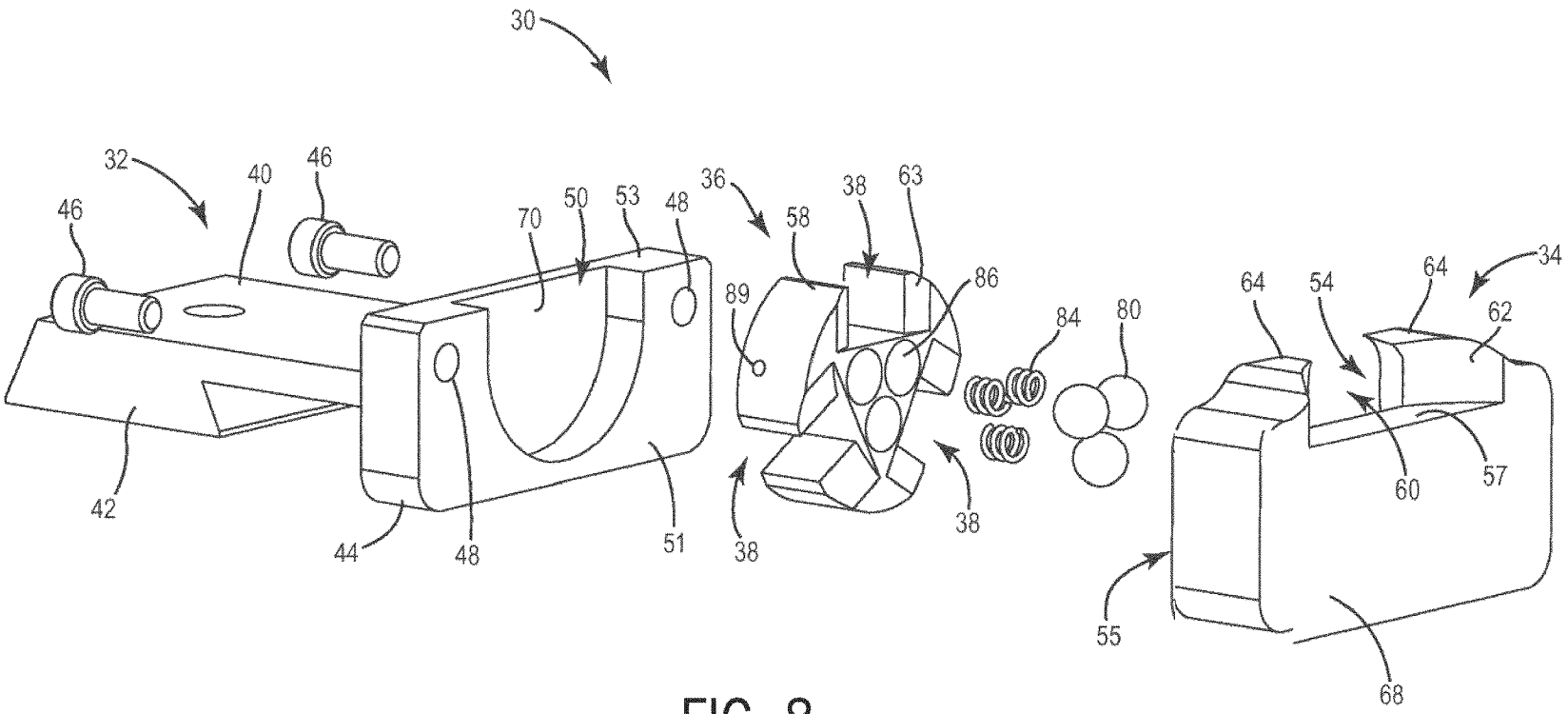
FIG. 8 is an exploded perspective view of the rear sight of FIG. 3.

In some embodiments, the second sighting notch may be one of a plurality of notches on a notched element, such as disc 32 in FIGS. 8-9.

In some embodiments, the second sighting notch may be configured to flip (e.g., to rotate, to pivot) between the first position and the second position. FIGS. 11-17 and the related disclosure below provide exemplary embodiments of such flipping notch.

Further, in some embodiments, the second sighting notch may be configured to slide, i.e., to perform a linear movement between the first position and the second position. For example, in some cases, the second sighting notch may be configured to slide horizontally, i.e., along a top surface of a firearm, on which the rear sight may be installed or mounted. Yet in some embodiments, the second sighting notch may be configured to slide vertically, i.e., perpendicular to a top surface of a firearm, on which the rear sight may be installed or mounted. FIGS. 18-27 and related disclosure below provide an exemplary embodiment of a second sighting notch configured to slide horizontally.

Figure 11:
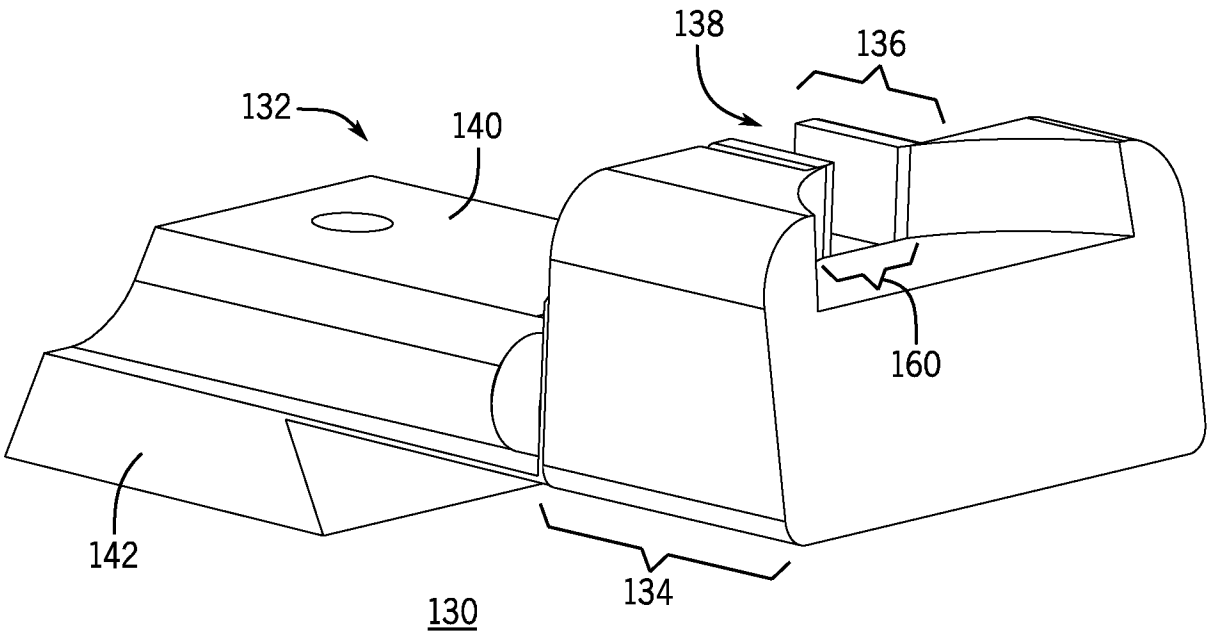
FIG. 11 is a perspective view of a "flip notch" rear sight for a firearm, according to an exemplary embodiment.
Figure 12:
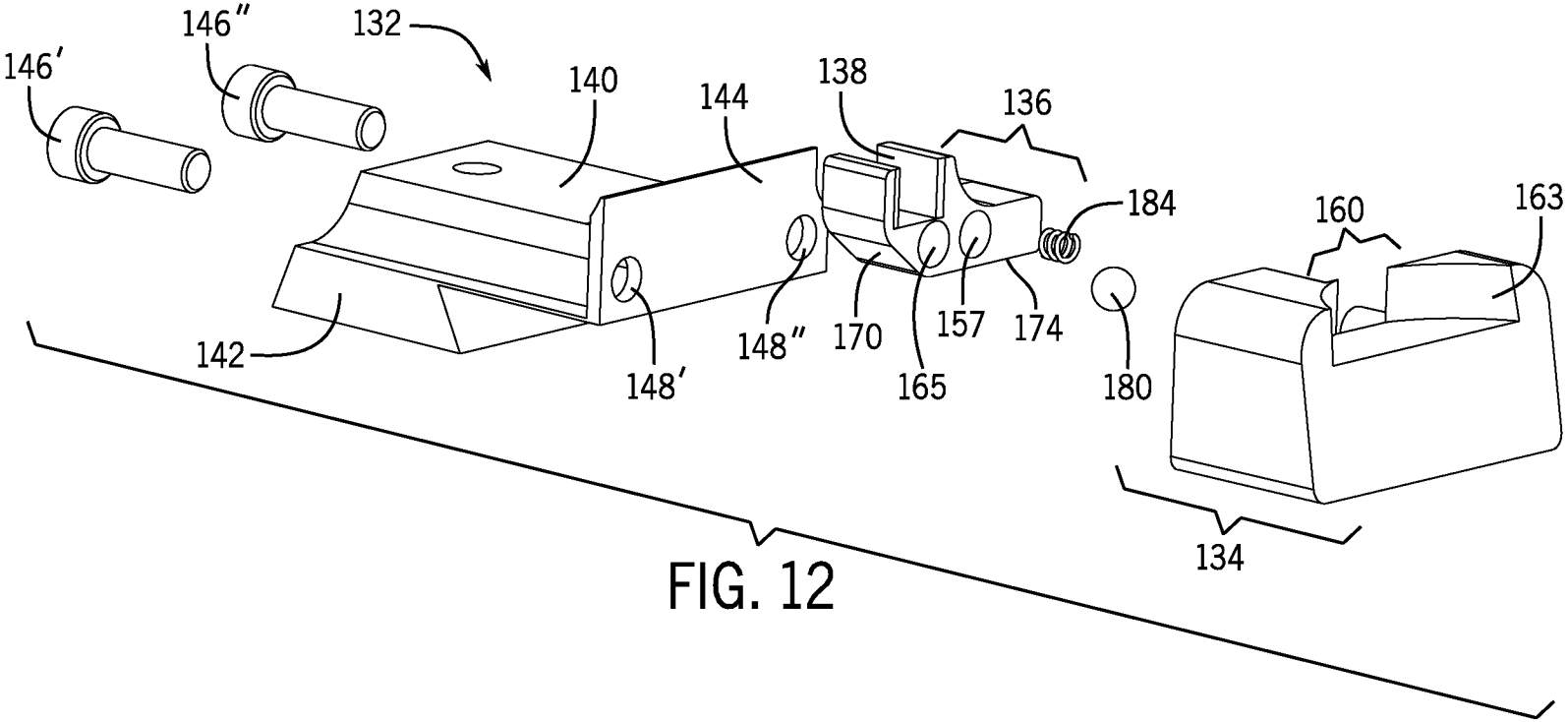
FIG. 12 is an exploded perspective view the "flip notch" rear sight of FIG. 11.
Figure 13A:
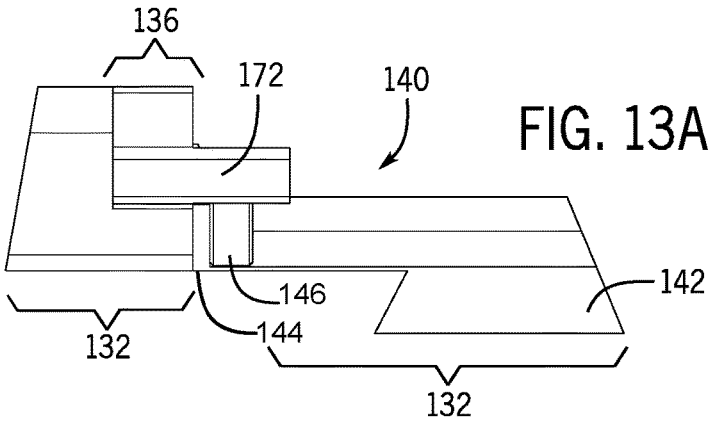
FIG. 13A is a side view of the "flip notch" rear sight of FIG. 11.
Figure 13B:
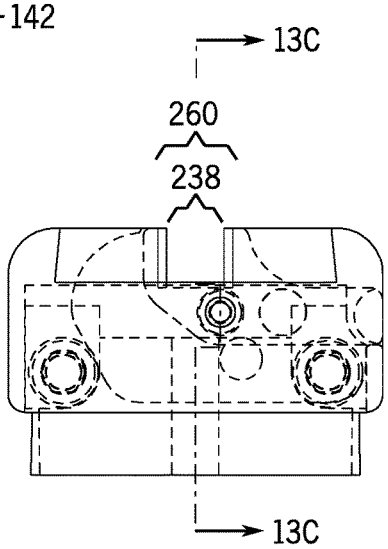
FIG. 13B is a rear view of the "flip notch" rear sight of FIG. 11.
Figure 13C:
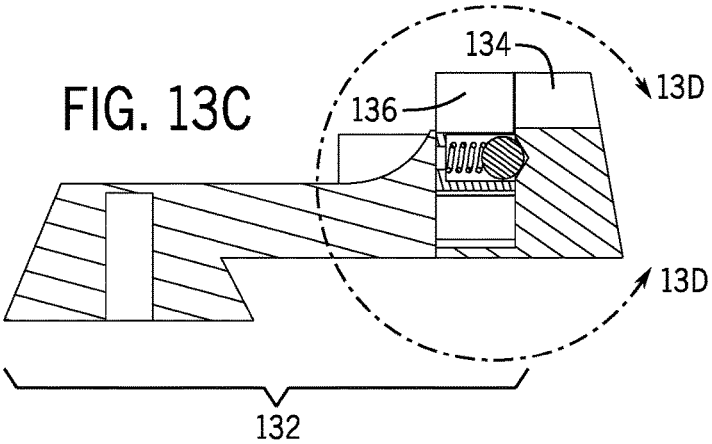
FIG. 13C is a cross-section view of the "flip notch" rear sight of FIG. 11.
Figure 13D:
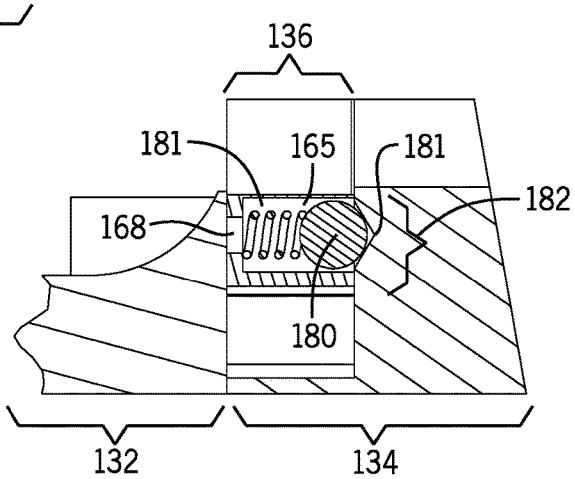
FIG. 13D is a detailed cross-section view of the "flip notch" rear sight of FIG. 11.
Figure 17A:
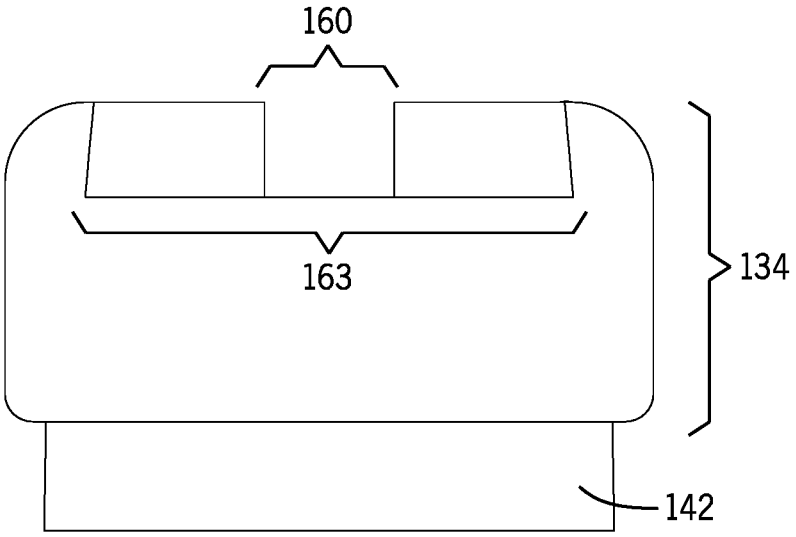
FIG. 17A is a rear view of the "flip notch" rear sight of FIG. 11 when a flipping element is in the first position.
Figure 17B:
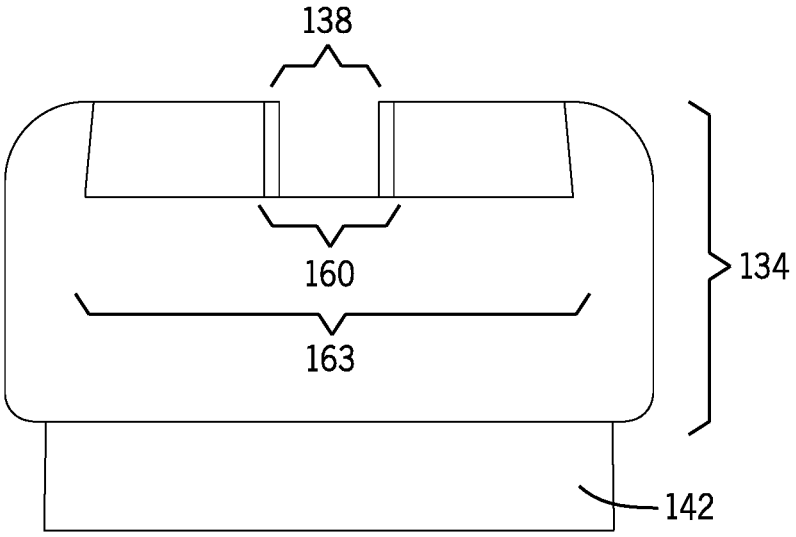
FIG. 17B is a rear view of the "flip notch" rear sight of FIG. 11 when a flipping element is in the second position.
Figure 18:
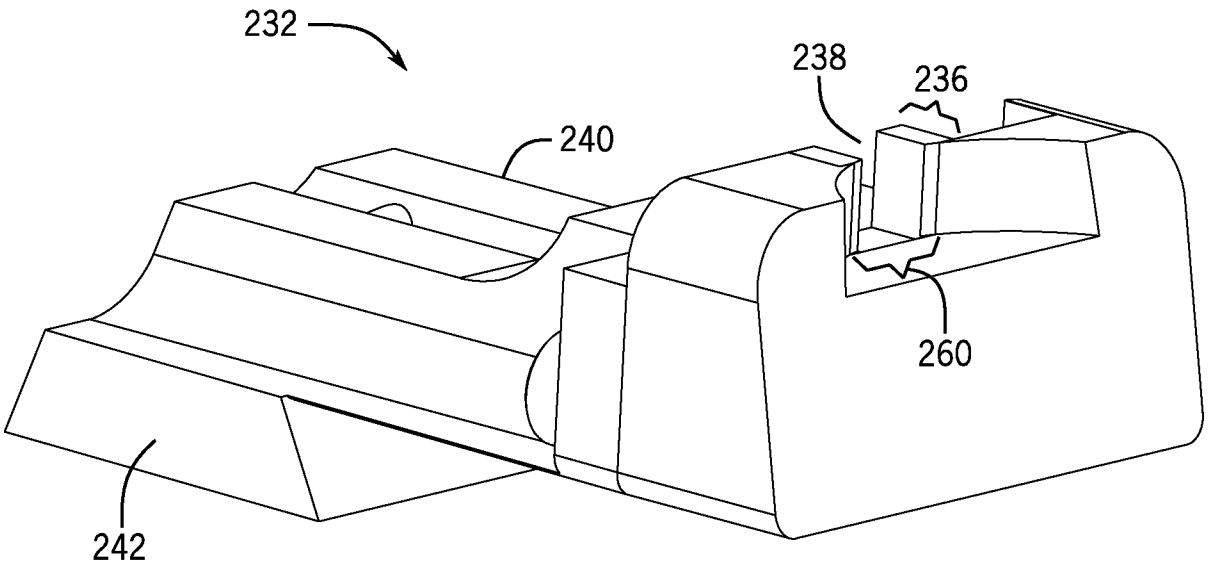
FIG. 18 is a perspective view of a "slide notch" rear sight for a firearm, according to an exemplary embodiment, from the rear side.
Figure 19:
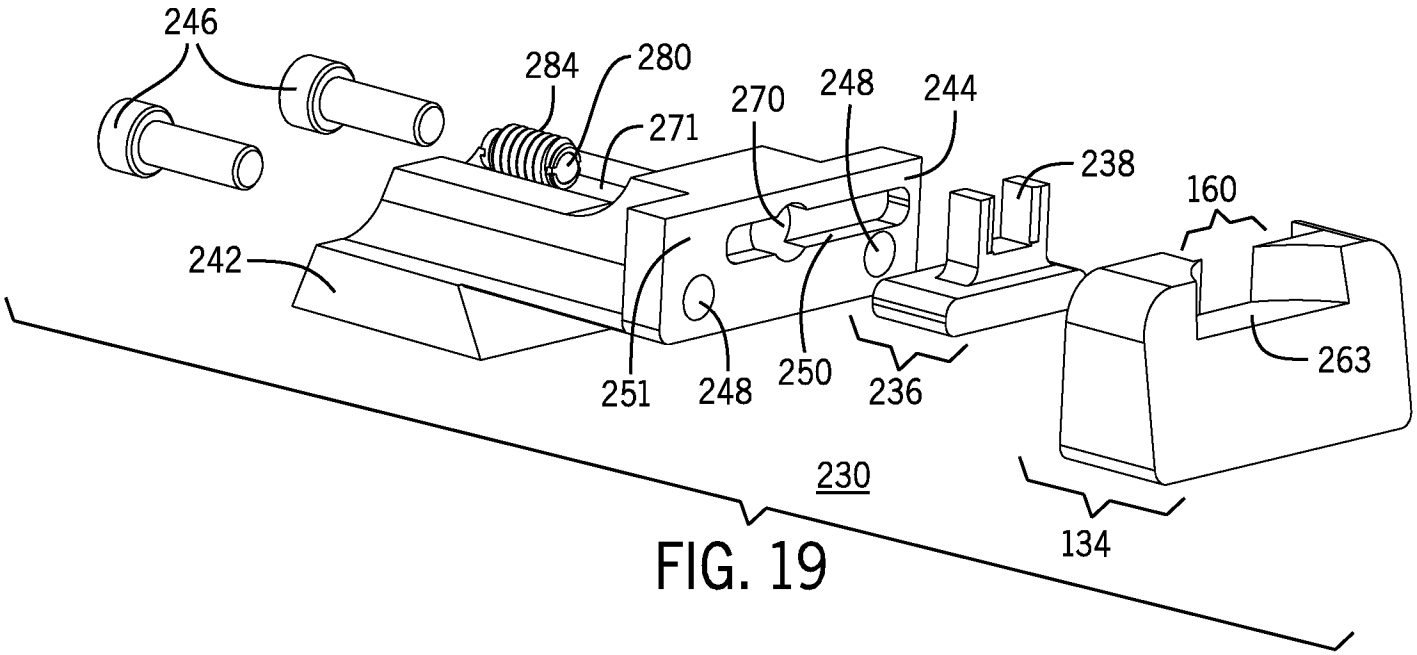
FIG. 19 is an exploded perspective view the "slide notch" rear sight of FIG. 18 from a rear side.
Figure 20C:
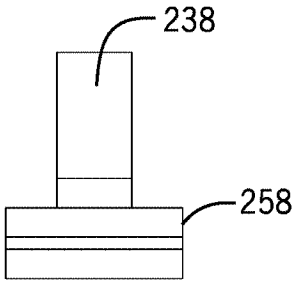
FIG. 20C is a side view of a sliding element of the "slide notch" rear sight of FIG. 18.
Figure 20B:
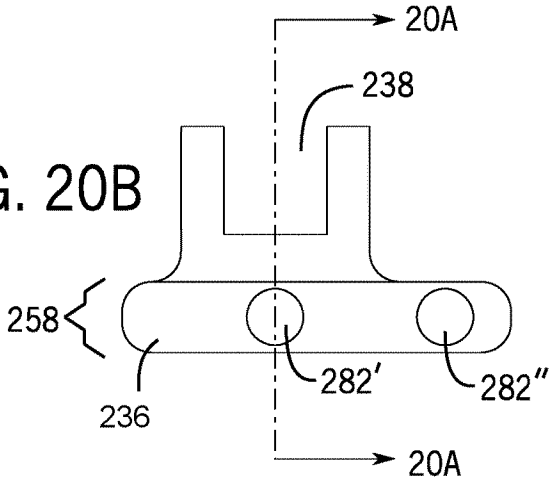
FIG. 20B is a front view of a sliding element of the "slide notch" rear sight of FIG. 18.

Rear sight 130 includes mounting base 132 configured to be coupled to upper surface 15 of the slide 14, rear slide blade 134 and flipping element 136 that is coupled to rear sight blade 134 and is configured to flip (to rotate, to pivot) relative to rear sight blade 134 and mounting base 132 between a first position and a second position. As shown in FIG. 11, rear sight blade includes first sighting notch 160, while flipping element 136 includes second sighting notch 138. When flipping element 136 is in the first position, flipping element 136, including second sighting notch 138, is not visible to a user of the firearm through first sighting notch 160 (FIG. 17A). Therefore, first sighting notch 160 is the effective sighting notch of rear sight 130. When flipping arm 136 is in the second position, second sighting notch 138 is visible through first sighting notch 160. (FIG. 17B). In such case, second sighting notch 138 is the effective sighting notch of rear sight 130.

Mounting base 132 includes arm 140, coupling member 142 configured to couple arm 140 to firearm 10 or other body, and blade supporting member 144 coupled to arm 140. In some embodiments, rear sight 130 may be a fixed position sight. That is, mounting base 132 may be configured as a static member such that the positions of the rear sight blade 134 and flipping arm 136 relative to firearm 10 are fixed. Mounting base 132 may be mounted to slide 14 with a dovetail joint. Coupling member 142 is a downwardly extending boss with a trapezoidal cross-sectional shape. Coupling member 142 is configured to engaged (e.g., slide into) a corresponding trapezoidal slot 43 machined or otherwise formed in slide 14. Slot 43 may be an existing, standard slot used for mounting a conventional sight to a firearm. In other embodiments, mounting base 132 may be coupled to another stationary member, such as an existing fixed rear sight.

In another embodiment, mounting base 132 may be moveable relative to upper surface 15 of firearm 10 so that the vertical position of rear sight blade 134 and flipping element 136 can be varied (see FIGS. 13A-13D). Mounting base 132 may be configured such that the horizontal position of the rear sight blade 134 and flipping element 136 can be varied. When it is used on an existing adjustable sight, mounting base 132 may be attached to the existing sight's adjustable arm that moves up/down and left/right. For example, mounting base 132 may be coupled to, integrated with, or similar in construction and function to a known adjustable rear sight, such as a BoMar adjustable rear sight, marketed by Kensight®.

Blade supporting member 144 provides a structure to which rear sight blade 134 is mounted. In some embodiments, blade supporting member 144 may also provide a structure to which flipping element 136 may be mounted as well. According to an exemplary embodiment, rear sight blade 134 is coupled to blade supporting member 144 with threaded fasteners 146' and 146" that pass through through-holes 148 in blade supporting member 144 and engage threaded holes 149' and 149" (see FIGS. 12 and 15B) in rear sight blade 134. Fasteners 146' and 146" may have the same or different length. In an exemplary embodiment, fastener 146" may be longer than fastener 146' because its respective threaded hole 149" is in a recessed portion of inner surface 155 of rear slide blade 134, while threaded hole 149' is on a non-recessed portion of inner surface 155. The removable nature of the threaded fasteners 146' and 146" allows rear sight blade 134 and flipping arm 136 to be removed from mounting base 132, for example, to service the internal components of rear sight 130, to replace flipping element 136 with a flipping element having a different sighting notch, etc. However, in other embodiments, rear sight blade 134 may be coupled to blade supporting member 144 with any suitable coupling mechanism, including welding, rivets, adhesives, etc.

Figure 15A:
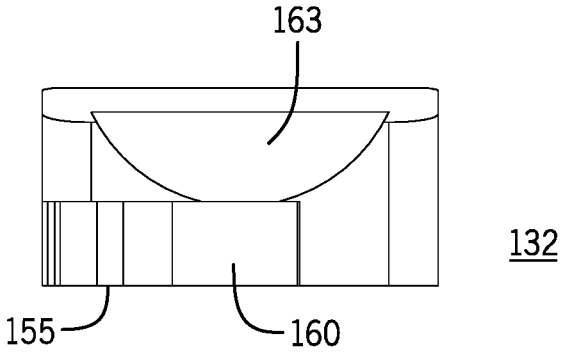
FIG. 15 A is a top view of a rear side blade of the "flip notch" rear sight of FIG. 11.
FIG. 15B is a front view of a rear side blade of the "flip notch" rear sight of FIG. 11.
FIG. 15C is a horizontal cross-sectional view of a rear side blade of the "flip notch" rear sight of FIG. 11.
Figure 15B:
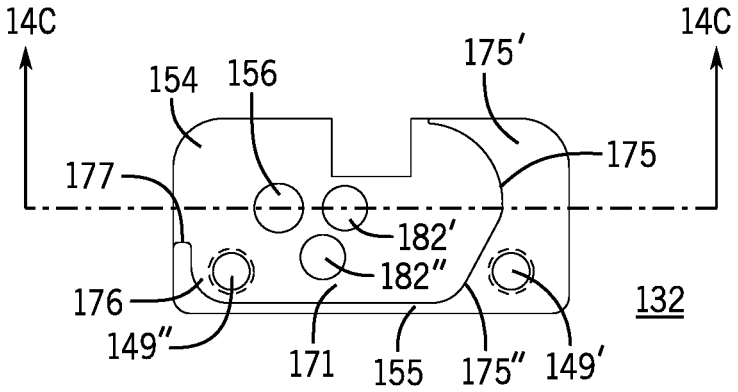
Figure 15C:
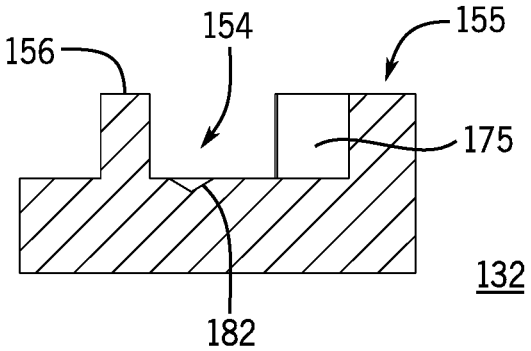

Inside surface 155 of rear sight blade 134 defines recess 154 (e.g., cut, hollow, void, etc.) that is configured to receive flipping element 136 and to allow a space for flipping (rotational, pivotal) movement of flipping element 136 between the first and the second positions (FIG. 15A-C). Recess 154 may include shaft (rod) 156 that is configured to receive flipping element 136 through matching shaft hole 157 and be an axis for the flipping (rotational) movement of flipping element 136 between the first and the second positions. Recess 154 may also include detents 182' and 182" configured to fix flipping element 136 in the first or the second position respectively. Preferably, shapes of flipping element 136 and recess 154 are matched so that rotation of flipping element 136 around shaft 156 within recess 154 is limited to movement between the first and the second positions.

Figure 14A:
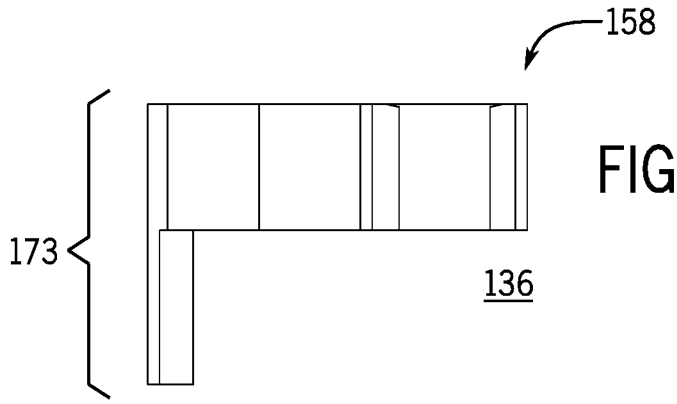
FIG. 14A is a top view of a flipping element of the "flip notch" rear sight of FIG. 11.
Figure 14B:
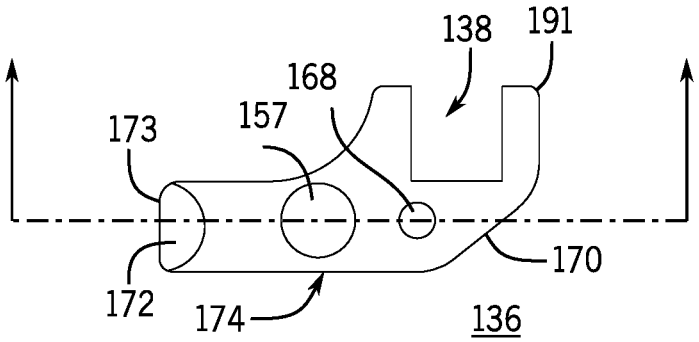
FIG. 14B is a front view of a flipping element of the "flip notch" rear sight of FIG. 11.
Figure 14C:
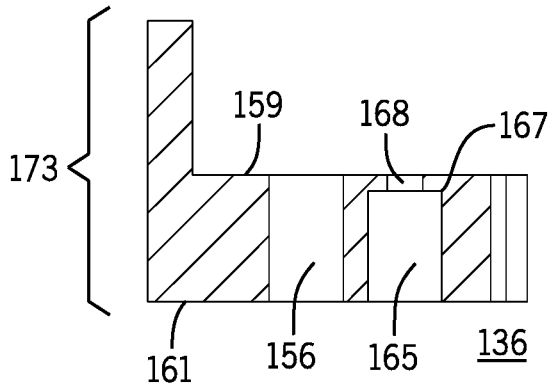
FIG. 14C is a horizontal cross-section view of a flipping element of the "flip notch" rear sight of FIG. 11.

Flipping element 136 include second sighting notch 138 positioned on base 158. Base 158 includes shaft hole 157 on surface 161, which faces rear side blade 134. In an exemplary embodiment in FIG. 14A-C, shaft hole 157 extends from surface 161 to surface 159, which faces blade supporting member 144. Shaft hole 157 is configured to fit into it shaft (rod) 156, which serves as an axis for the flipping (rotational) movement of flipping element 136 between the first and the second positions. Base 158 may also include hole 165, which extends from surface 161 perpendicular to that surface. Hole 165 may be configured to receive spring 184 which depresses ball 180 over one of detents 182' and 182" to fix flipping element 136 in the first or the second position respectively. Hole 165 includes stopping surface 167 over which spring 184 may compress. Thus, hole 165 does not extend from surface 161 to surface 159. An exemplary embodiment in FIG. 14A-C shows hole 168, which extends from stopping surface 167 to surface 159 and which has a diameter smaller than a diameter of hole 165. Hole 168 may allow air within hole 165 to escape as ball 180 is forced into one of detents 182' or 182". Further, hole 168 may allow for a small tool to be inserted into hole 165, such as to push out a spring 184 or ball 80 from hole 165.

Base 158 may have a diagonal cut perpendicular to surfaces 161 and 159. Such diagonal cut may form diagonal surface 170, which is configured to rest over bottom surface 171 of recess 154 when flipping element 136 is in the second position and thereby stabilize the flipping element in that position.

Flipping element 136 may include a lever, which may be used by a user of a firearm to flip flipping element 136 between the first and the second positions. The lever may allow the user of the firearm to quickly and efficiently change notches in the flip-notch rear sight. FIG. 14A-C show lever 172 extending from surface 159 of base 158 perpendicular to that surface in the direction of blade supporting member 144. Joint side surface 173 of lever 172 and base element 158 may be serrated. For example, joint side surface 173 may include horizontal serrations. Such serrations may make it easier for the user of the firearm to make a contact with the lever surface, thereby, making the process of changing notches quicker and more efficient.

Preferably, shapes of flipping element 136 and recess 154 are matched so that rotation of flipping element 136 around shaft 156 within recess 154 is limited to movement between the first and the second positions. According to an exemplary embodiment in FIG. 15 A-C, the shape of recess is defined by surfaces 171, 175, 176 and 177. Surface 171 is a flat surface at the bottom of recess 154. Diagonal surface 170 rests over surface 171 when flipping element 136 is in the second position. Such resting stabilizes flipping element 136 in that position. Curved side surface 175 includes upper section 175', which is an arc with its center corresponding to the center of shaft 156, and lower portion 175". A radius of the arc is slightly greater than a distance between the center of shaft hole 157 and upper right edge 191 (FIG. 14B) of flipping element 136 in order to allow the flipping (rotational) movement of flipping element 136 around shaft 156 between the first and the second positions. Lower portion 175" of curved surface 175 is configured to be such so that it does not impede the flipping (rotational) movement of flipping element 136 around shaft 156 between the first and the second positions. Vertical surface 176 ends with horizontal surface 177, which is configured to have a portion of bottom surface 174 of flipping element 136, which may be a bottom surface of base 158 and/or a bottom surface of lever 172, rested on it when flipping element 136 is in the second position. As such, a vertical dimension (height) of surface 176 may be defining the second position. Resting of the portion of bottom surface 174 of flipping element 136 on horizontal surface 177 may stabilize flipping element in the second position.

Recess 154 on surface 155 of rear blade may include detents 182' and 182" configured to fix flipping element 136 in the first or the second position respectively. Detents 182 are configured to accept, hold, or position ball 180 compressed by spring 184 placed in hole 165 against stopping surface 167. Detents 182' and 182" may be formed as small diameter spherical holes with a conical base portion. For example, detents 182' and 182" may be formed as spherical basins (e.g., bowl-shaped depressions) each with a diameter larger than the diameter of ball 180 and including a hole, shown as a conical hole 181 shown in FIG. 13D, for example, at the base of each depression in order to locate ball 180 within the depression. Thus, in this embodiment ball 180 is retained in position by resting on the circular rim of base hole 181 (the depth of which may be configured in a non-conical shape). However, the detents may be formed as any hollow feature that receives a portion of ball 180. For example, the detents may be formed as conical holes or a cylindrical hole with a diameter that is less than the diameter of ball 180 such that ball 180 rests on the circumference or edge of the hole.

Detents 182' and 182" may be configured to fix flipping element 136 in the first or the second position respectively when ball 180 is depressed over an individual detent by compressing spring 184 placed in hole 165 against stopping surface 167.

FIG. 15A shows a top-view of rear sight blade element 134 which includes first sighting notch 160. Upper surface 162 may include radial recess (cut) 163, which may be symmetrical with respect to the axis of first sighting notch 160. A depth of recess 163 may be the same as a depth of first sighting notch 160. Recess 163 may allow a user of the firearm, on which rear sight 130 is installed or mounted, to have a smooth visual transition from first sighting notch 160 to second sighting notch 138 when flipping element 136 is in the second position. With such radial recess, vertical sides of first sighting notch 160 may be less noticeable, distracting or standout for the use when second sighting notch 138 is positioned in front of first sighting notch 160, i.e., when second sighting notch 138 and flipping element 138 are in the second position so that the second sighting notch is the effective sighting notch of rear sight 130.

Figure 16A:
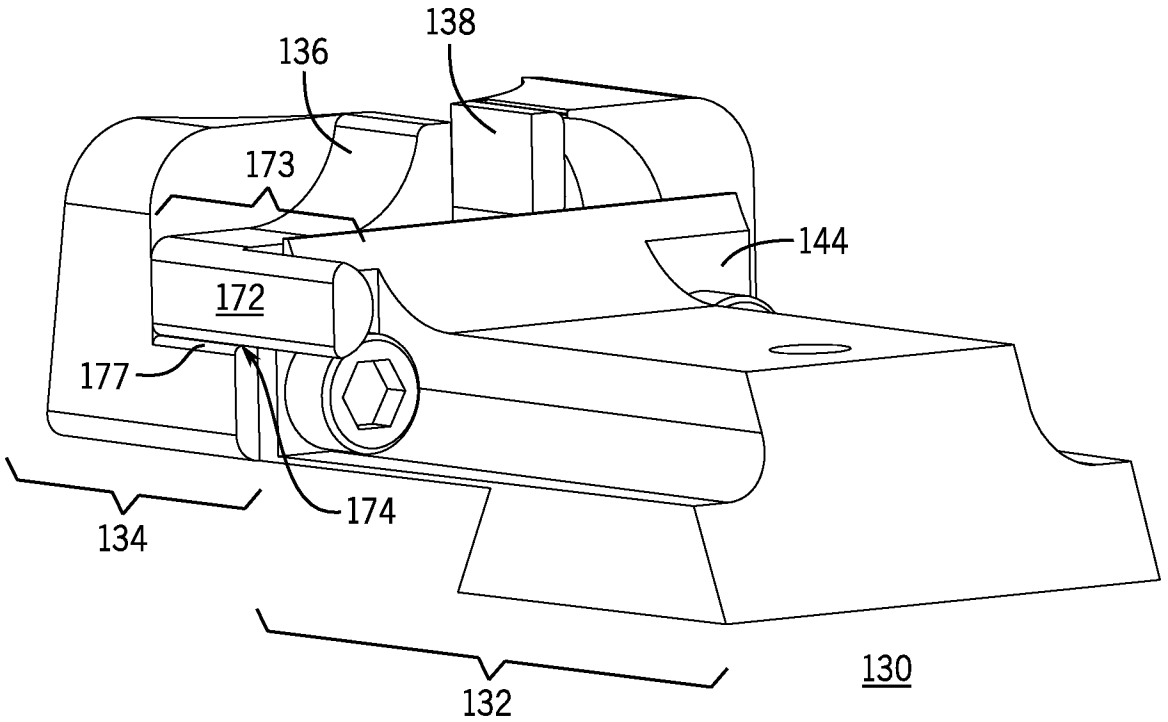
FIG. 16A is a front perspective view of the "flip notch" rear sight of FIG. 11 with a lever shown in a first position.
Figure 16B:
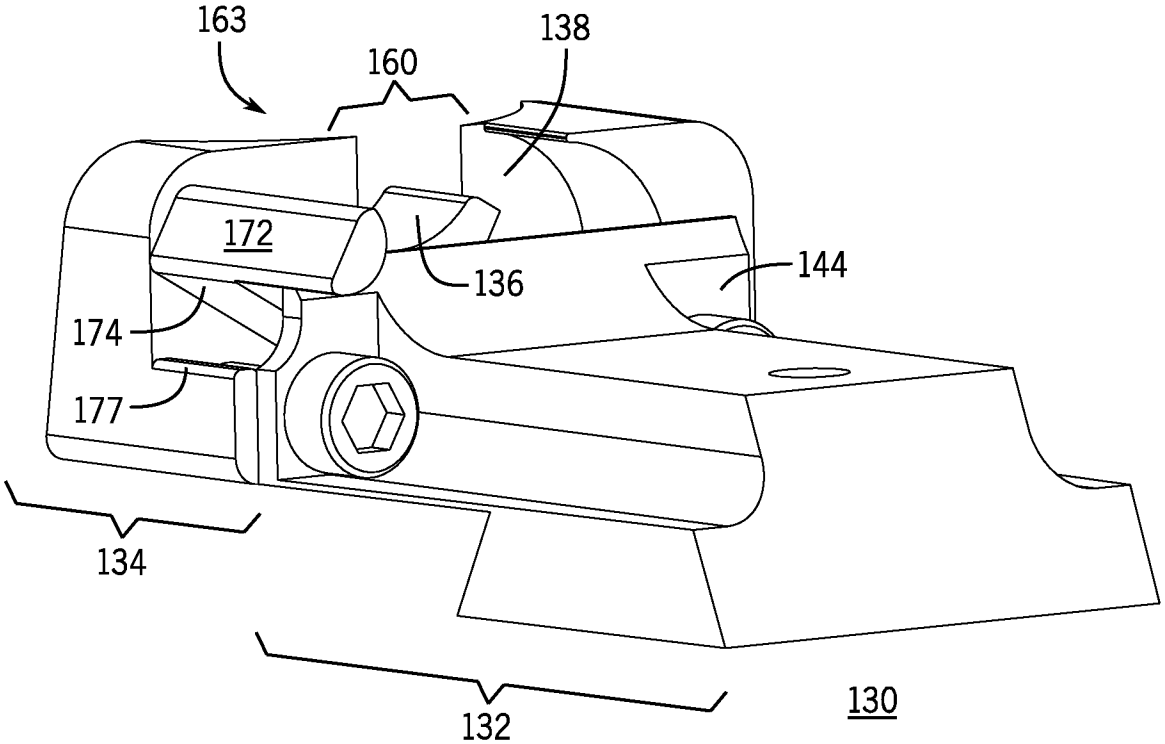
FIG. 16B is a front perspective view of the "flip notch" rear sight of FIG. 11 with a lever shown in a second position.
Figure 16C:
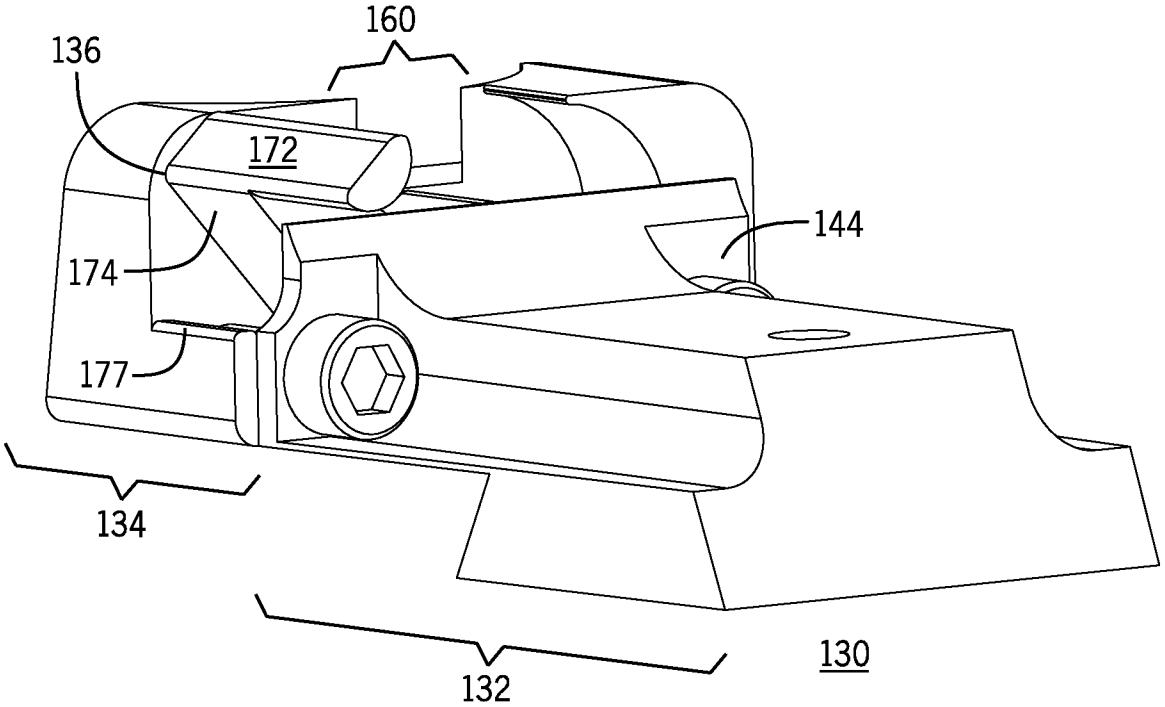
FIG. 16C is a front perspective view of the "flip notch" rear sight of FIG. 11 with a lever shown in a third position.

FIG. 16A-C illustrate the flip-notch rear sight 130. FIG. 16A shows flipping element 136 in the second position, in which second sighting notch 138 is visible through first sighting notch 160 and bottom surface 174 of flipping element 136 rests on surface 177. In such situation, second sighting notch 138 is the effective sighting notch of flip-notch rear sight 130. FIG. 16C shows flipping element 136 in the first position, in which second sighting notch 238 is not visible through first sighting notch 160 and bottom surface 174 of flipping element 136 is lifted from surface 177 undergoing flipping or rotation (clockwise with respect to the situations of FIGS. 16A and 16B). In such case, first sighting notch 160 is the effective sighting notch of slide-notch rear sight 130. FIG. 16B shows flipping element 136 in a position which is intermediate between the first and the second positions such that bottom surface 174 of flipping element 136 is partially lifted from surface 177 undergoing flipping or rotation (clockwise with respect to the situation of FIG. 16A) while still remaining partially visible through first sighting notch 160.

Rear sight 230 includes mounting base 232 configured to be coupled to upper surface 15 of the slide 14, rear slide blade 234 and sliding element 236 that is coupled to rear sight blade 234 and is configured to slide, i.e. to perform a linear movement, horizontally relative to rear sight blade 234 and mounting base 232 between a first position and a second position. Rear sight blade includes groove 254, while sliding element 236 includes second sighting notch 238. When sliding element 236 is in the first position, sliding element 236, including second sighting notch 238, is not visible to a user of the firearm through first sighting notch 260, see e.g., FIG. 24A. Therefore, first sighting notch 260 is the effective sighting notch of rear sight 230. When sliding element 236 is in the second position, second sighting notch 238 is visible through first sighting notch 260, see e.g., FIG. 24B. In such case, second sighting notch 238 is the effective sighting notch of rear sight 230.

Mounting base 232 includes arm 240, coupling member 242 configured to couple arm 240 to firearm 10 or other body, and blade supporting member 244 coupled to arm 240. In some embodiments, rear sight 130 may be a fixed position sight. That is, mounting base 232 may be configured as a static member such that the positions of rear sight blade 234 and sliding arm 236 relative to firearm 10 are fixed. Mounting base 232 may be mounted to slide 14 with a dovetail joint. Coupling member 242 is a downwardly extending boss with a trapezoidal cross-sectional shape. Coupling member 242 is configured to engaged (e.g., slide into) a corresponding trapezoidal slot 43 machined or otherwise formed in slide 14. Slot 43 may be an existing, standard slot used for mounting a conventional sight to a firearm. In other embodiments, mounting base 232 may be coupled to another stationary member, such as an existing fixed rear sight.

In another embodiment, mounting base 232 may be moveable relative to upper surface 15 of firearm 10 so that the vertical position of rear sight blade 234 and sliding element 236 can be varied. Mounting base 232 may be configured such that the horizontal position of the rear sight blade 234 and sliding element 236 can be varied. When it is used on an existing adjustable sight, mounting base 232 may be attached to the existing sight's adjustable arm that moves up/down and left/right. For example, mounting base 232 may be coupled to, integrated with, or similar in construction and function to a known adjustable rear sight, such as a BoMar adjustable rear sight, marketed by Kensight®.

Blade supporting member 244 provides a structure to which rear sight blade 234 is mounted. In some embodiments, blade supporting member 244 may also provide a structure to which sliding element 236 may be mounted as well. According to an exemplary embodiment, rear sight blade 234 is coupled to blade supporting member 244 with threaded fasteners 246 that that pass through through-holes 248 in blade supporting member 244 and engage threaded holes 249 (see FIG. 19) in rear sight blade 234. The removable nature of the threaded fasteners 246 allows rear sight blade 234 and sliding element 236 to be removed from mounting base 232, for example, to service the internal components of rear sight 230, to replace sliding element 236 with a sliding element having a different sighting notch etc. However, in other embodiments, rear sight blade 234 may be coupled to blade supporting member 244 with any suitable coupling mechanism, including welding, rivets, adhesives, etc.

One or both of a) inside surface 251 of blade supporting member 244 and b) inside surface 255 of rear side blade 234 may include a groove configured to allow sliding of sliding element 236 to slide between the first and the second positions. According to an exemplary embodiment, inside surface 251 of blade supporting member 244 includes groove 250, while inside surface 255 of rear side blade 234 includes groove 254.

Sliding element 236 includes second sighting notch 238 positioned on base 258, preferably perpendicular to a horizontal surface of base 258 and parallel to side surfaces of base 258, which face mounting base 232 and blade supporting member 244. Base 258 is configured to fit into groove(s) on a) inside surface 251 of blade supporting member 244 and b) inside surface 255 of rear side blade 234, such as grooves 250 and 254, to allow sliding element 236 to slide between the first position and the second position. As such, a thickness (a dimension perpendicular to the horizontal surface) of base 258 matches a width of groove(s) on a) inside surface 251 of blade supporting member 244 and b) inside surface 255 of rear side blade 234, such as grooves 250 and 254. A length (a dimension along the sliding direction) of base 258 is smaller than a length of groove(s) on a) inside surface 251 of blade supporting member 244 and b) inside surface 255 of rear side blade 234, such as grooves 250 and 254. A relationship between the length of base 258, the length of the groove(s), such as grooves 250 and 254, and the position of second sighting notch 238 on base 258 may be such that edges of the groove(s) define the first and the second position. Thus, when base 258 reaches one edge of the groove(s), such as grooves 250 and 254, second sighting notch 238 may be in the first position and when base 258 reaches the other edge of the groove(s), such as grooves 250 and 254, second sighting notch 238 may be in the second position.

Side surface 263 of base 258, which faces blade supporting member 244, may include detents 282' and 282". Detents 282 are configured to accept, hold, or position ball 280 of spring plunger 284. Detents 282' and 282" may be formed as small diameter spherical holes with a conical base portion. For example, detents 282' and 282" may be formed as spherical basins (e.g., bowl-shaped depressions) each with a diameter larger than the diameter of ball 280 and including a hole, shown as a conical hole 281, at the base of each depression in order to locate ball 280 within the depression. Thus, in this embodiment ball 280 is retained in position by resting on the circular rim of base hole 281 (the depth of which may be configured in a non-conical shape). However, the detents may be formed as any hollow feature that receives a portion of ball 280. For example, the detents may be formed as conical holes or a cylindrical hole with a diameter that is less than the diameter of ball 280 such that ball 280 rests on the circumference or edge of the hole.

Detents 282' and 282" may be configured to fix sliding element 236 in the first or the second position respectively when ball 280 is depressed over an individual detent by compressing the spring of spring plunger 284. Blade supporting member 244 may include threaded hole 270, which is configured to provide access to spring plunger 284. Outside blade supporting member 244 threaded hole 270 may have a non-threaded extension as groove 271, which may be extending along the length of arm 240. Groove 271 may be used for directed spring plunger 284 into threaded hole 270.

In some embodiments, sliding element 236 may include an arm or a handle, which may be configured to be used to a user of a firearm for sliding of sliding element 236 between the first and the second positions. In some embodiments, such arm or handle may be positioned on a surface of sliding element 236, which faces mounting base 232. For example, in some embodiments, such arm or handle may be positioned on the surface of sliding element 236, which faces mounting base 232, perpendicular to that surface extending over blade supporting member 244.

Figure 21:
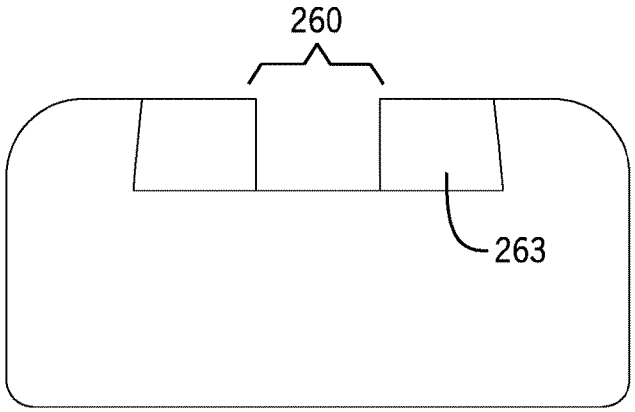
FIG. 21 is a rear view of a rear side blade of the "slide notch" rear sight of FIG. 18.
Figure 20A:
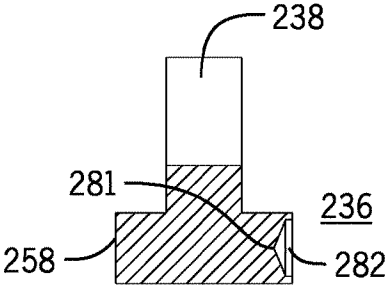
FIG. 20A is a cross-section view of a sliding element of the "slide notch" rear sight of FIG. 18.
Figure 22A:
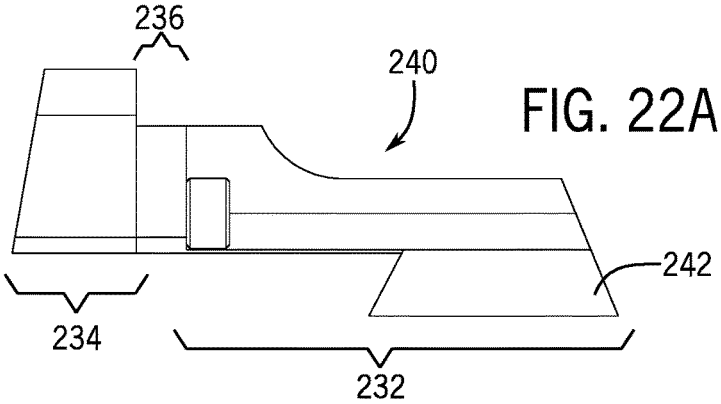
FIG. 22A is a side view of the "slide notch" rear sight of FIG. 18.
Figure 22B:
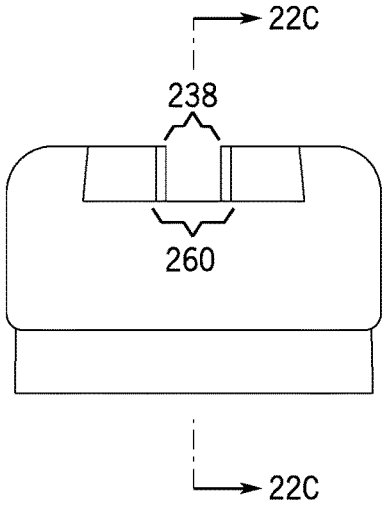
FIG. 22B is a rear view of the "slide notch" rear sight of FIG. 18.
Figure 22C:
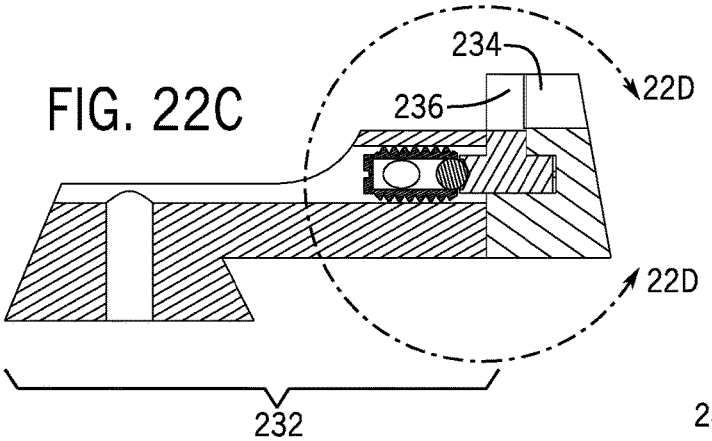
FIG. 22C is a cross-section view of the "slide notch" rear sight of FIG. 18.
Figure 22D:
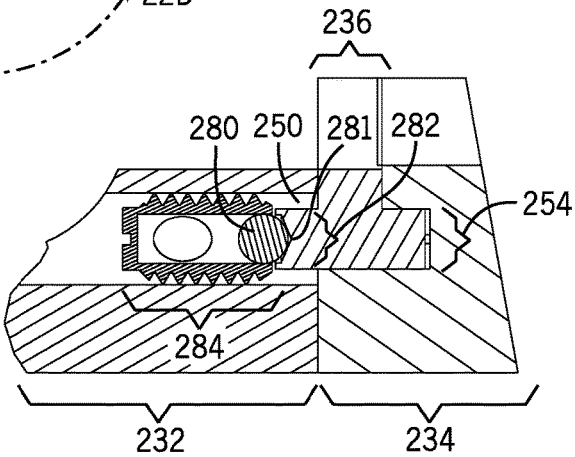
FIG. 22D is a detailed cross-section view of the "slide notch" rear sight of FIG. 18.

FIG. 21 shows a rear view of rear sight blade element 234 which includes first sighting notch 260. Upper surface 262 may include recess 263, which may be symmetrical with respect to the axis of first sighting notch 260. A depth of recess 263 may be the same as a depth of first sighting notch 260. Recess 263 may allow a user of the firearm, on which rear sight 230 is installed or mounted, to have a smooth visual transition from first sighting notch 260 to second sighting notch 238 when sliding element 236 is in the second position. With such radial recess, vertical sides of first sighting notch 260 may be less noticeable, less distracting or stand out less for the user when second sighting notch 238 is positioned in front of first sighting notch 260, i.e., when second sighting notch 238 and sliding element 236 are in the second position so that the second sighting notch is the effective sighting notch of rear sight 230.

Figure 23A:
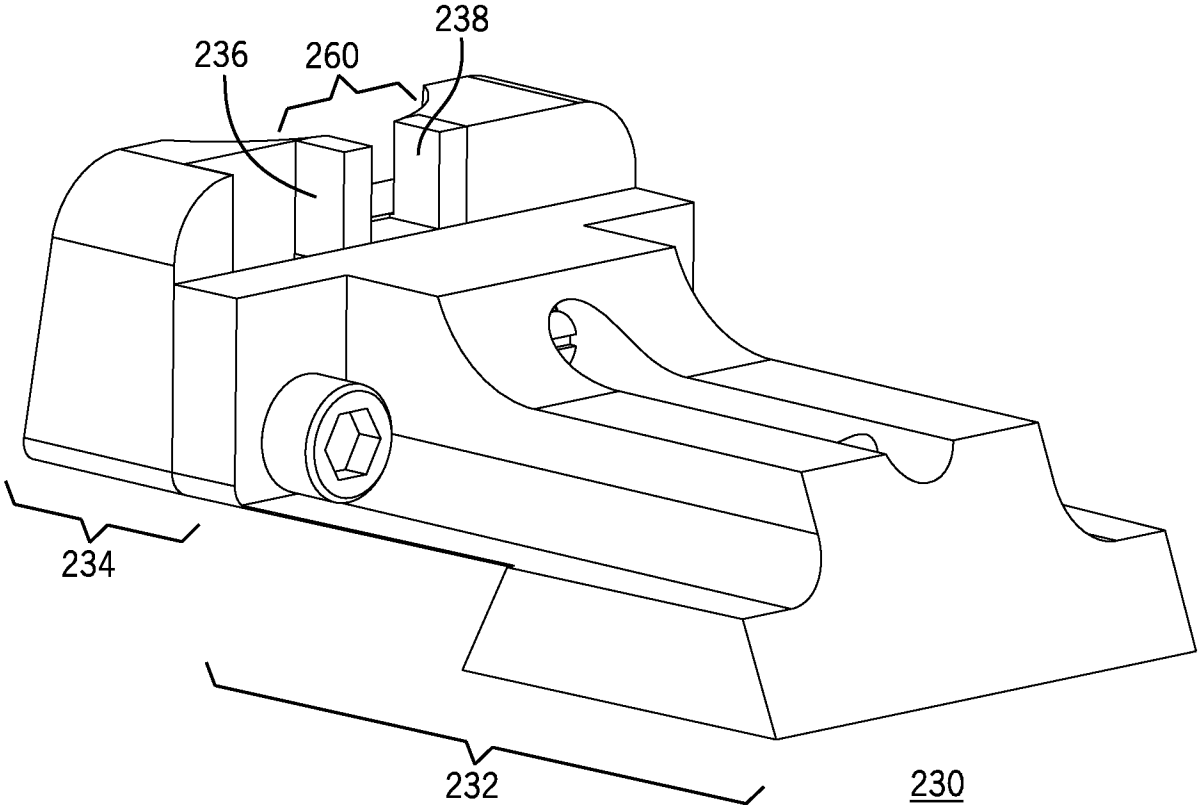
FIG. 23A is a front perspective view the "slide notch" rear sight of FIG. 18 in a first position.
Figure 23B:
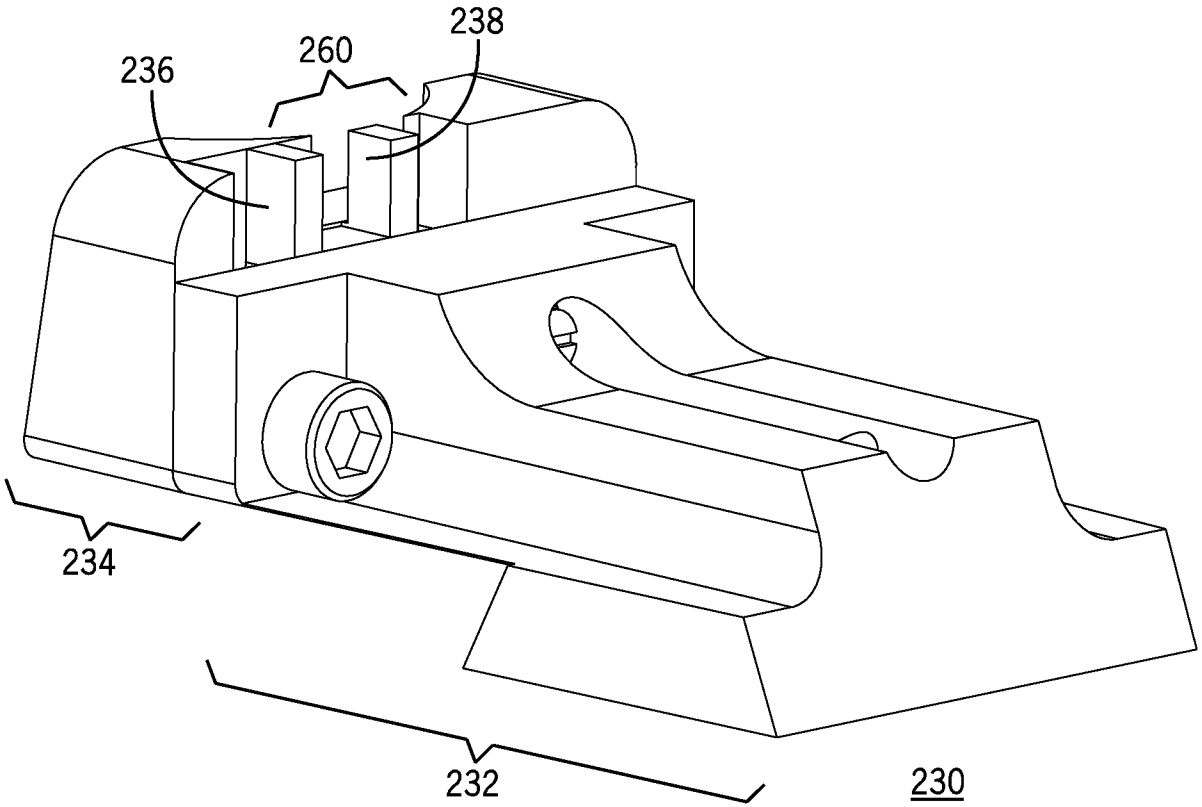
FIG. 23B is a front perspective view the "slide notch" rear sight of FIG. 18 in a second position.
Figure 23C:
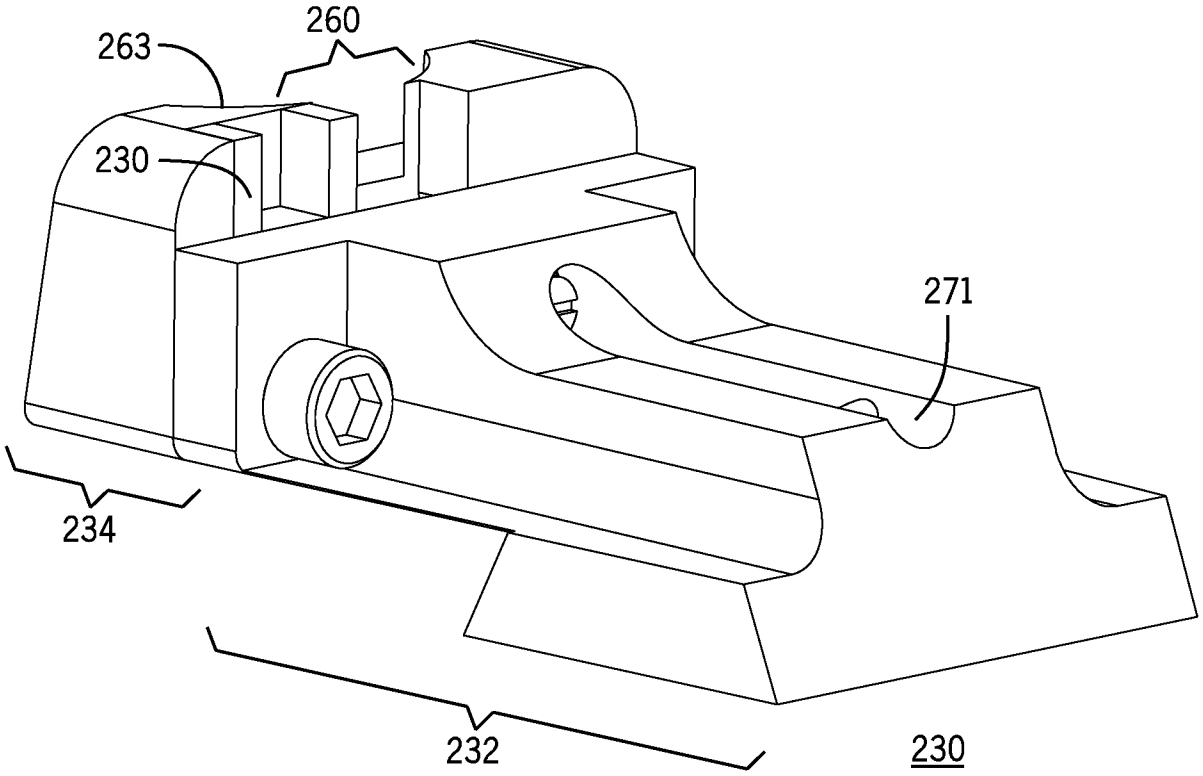
FIG. 23C is a front perspective view the "slide notch" rear sight of FIG. 18 in a third position.
Figure 24A:
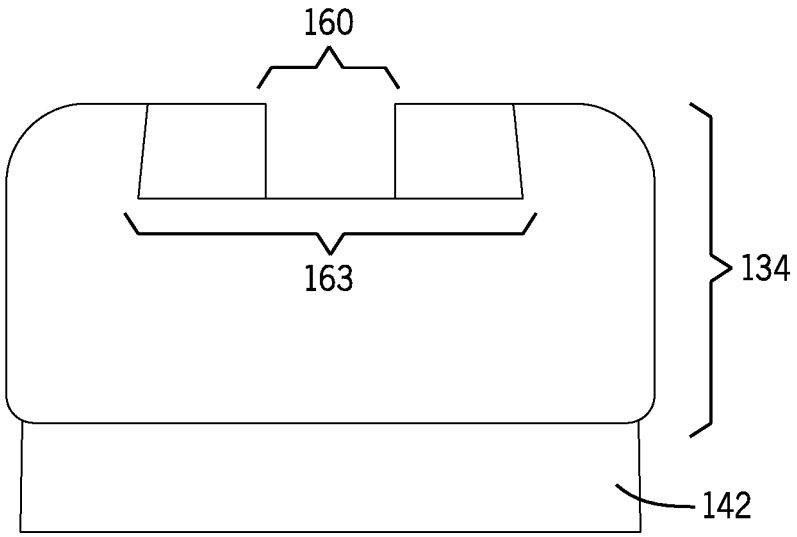
FIG. 24A is a rear view of the "slide notch" rear sight of FIG. 18 when a sliding element is in a first position.
Figure 24B:
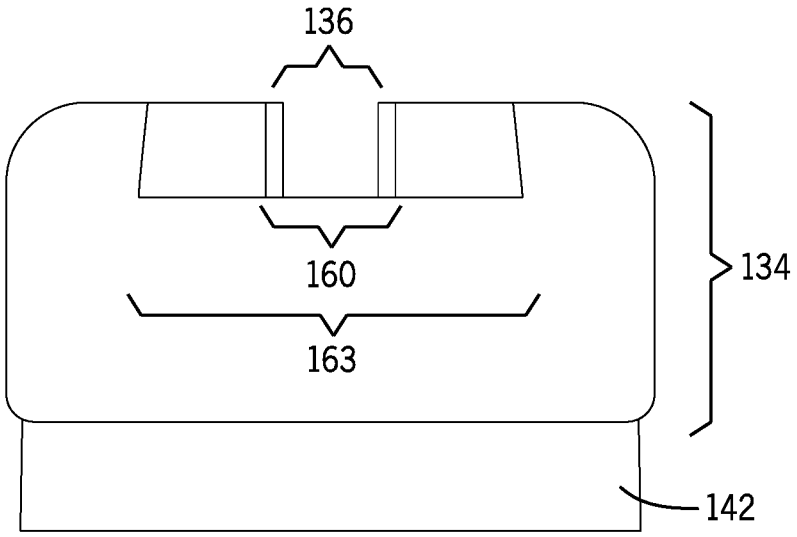
FIG. 24B is a rear view of the "slide notch" rear sight of FIG. 18 when a sliding element is in a second position.

FIG. 23A-C illustrate the slide-notch rear sight 230. FIG. 23A shows sliding element 236 in the second position, in which second sighting notch 238 is visible through first sighting notch 260. In such a situation, second sighting notch 238 is the effective sighting notch of slide-notch rear sight 230. FIG. 23C shows sliding element 236 in the first position, in which second sighting notch 238 is not visible through first sighting notch 260. In such case, first sighting notch 260 is the effective sighting notch of slide-notch rear sight 230. FIG. 23B shows sliding element 236 in a position which is intermediate between the first and the second positions. In such case, second sighting notch 238 is partially visible through first sighting notch 260. For the intermediate situation of FIG. 23B, rear sight 230 cannot be used for targeting a firearm.

Figure 25A:
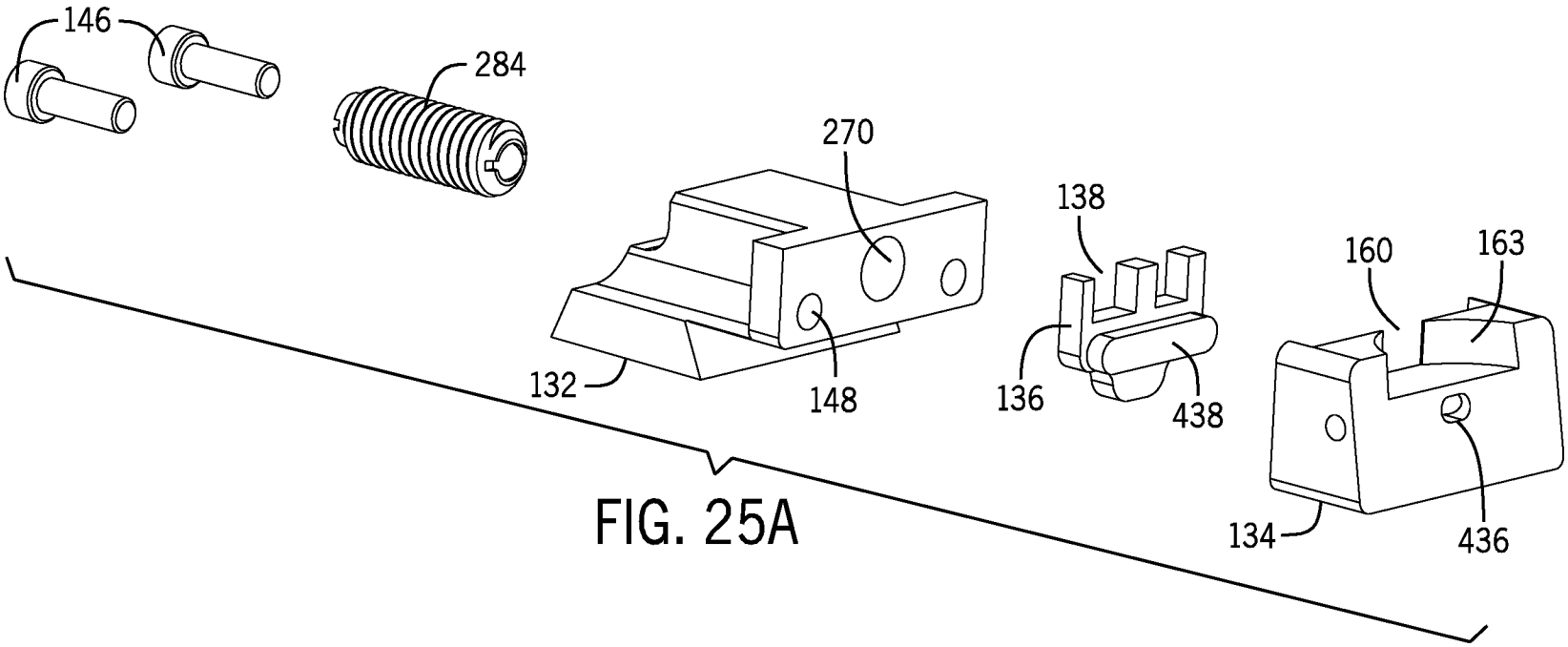
FIG. 25A is an exploded view of an alternative exemplary embodiment of a "slide notch" rear sight.

Various alternative embodiments may omit the spring and ball bearings described above. For example, FIG. 25A shows an exploded view of an alternative embodiment of a "slide notch" rear sight that does not employ springs and ball bearings. As shown in FIG. 25A, fasteners 146 are configured to pass through through-holes 148 of rear sight 130. A ball plunger 284 is configured to be inserted into a threaded hole 270 of a rear sight 130 having a mounting base 132. That is, in lieu of a spring and ball bearing, the embodiment shown in FIG. 25A uses the ball plunger 284 which reduces assembly time and requires fewer components. The plunger 284 applies pressure to the sliding element to prevent the sliding element from moving once it is positioned in a first or second position as described above. The sliding element includes at least one notch (such as notch 138) and a bar 438 proximate to the rear slight blade 134. The bar 438 is configured to slide into a groove on the back of the rear sight blade. The plunger 284 is configured to exert a force on one or more notches (e.g., notch 138). An external force acting on the sliding element in the sliding direction may act against the plunger 284, and if the sliding force is higher than the retaining force of the plunger 284, the sliding element moves. The plunger 284 continues to exert force during the sliding motion, and if the force continues until another notch is reached in the sliding direction, the plunger 284 will act on the notch, so as to move the sliding element from a first position to a second position. In some alternative embodiments, the ball plunger may be a short press-fit ball plunger (e.g., a press-fit Delrin ball plunger) made of a material such as stainless steel.

In addition, while the sliding element shown in FIG. 25A includes the notches 138 between three posts, in certain embodiments, an outer post may be omitted. That is, the sliding element may be manufactured with only two posts, or the space between an outer post and a center post may be filled in with material.

Further, the rear sight blade 134 is configured to have a horizontal opening 436. The horizontal opening 436 may be drilled into the rear sight blade 134 and is configured to receive a lighting element. For example, the horizontal opening 436 may receive a tritium lamp (e.g., in the form of a tritium vial) to aid in low-light shooting. In some embodiments, the opening 436 may be configured to receive more than one lighting element, or may comprise two openings each configured to receive a lighting element.

Figure 25B:
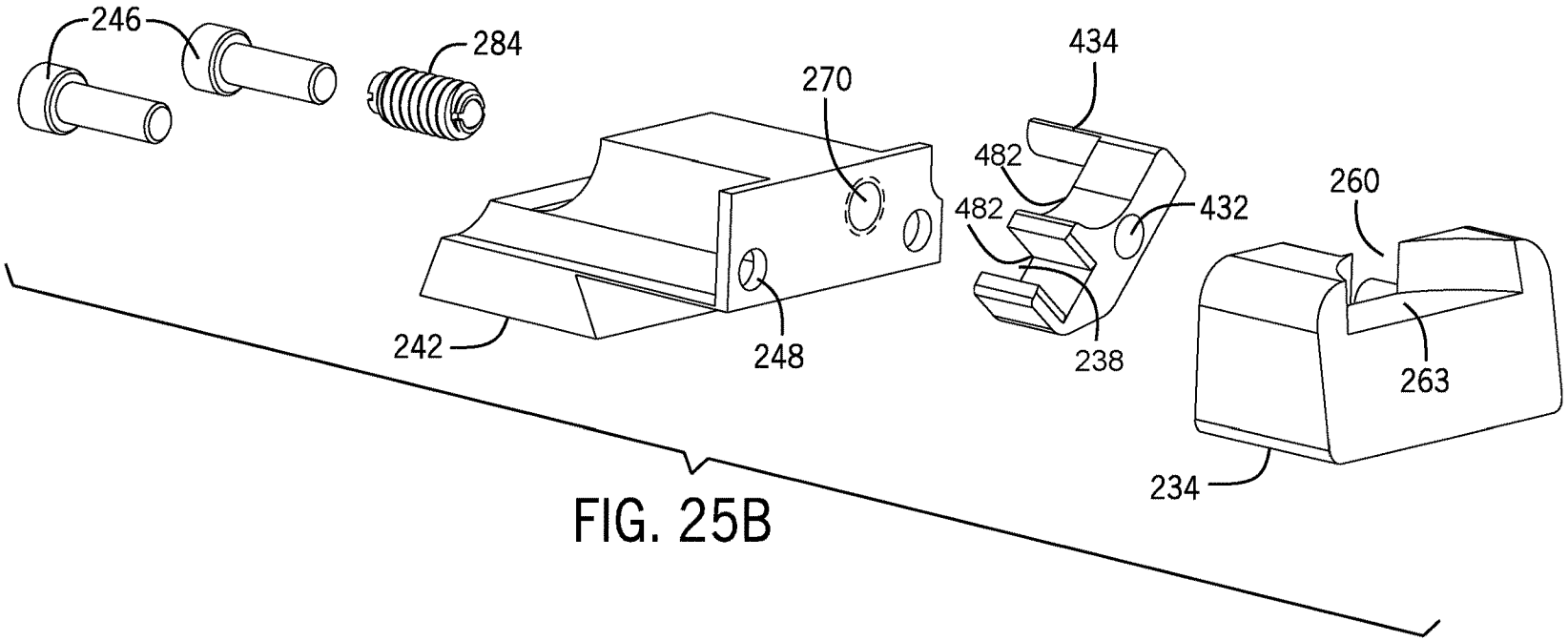
FIG. 25B is an exploded view of an alternative exemplary embodiment of a "flip notch" rear sight.

FIG. 25B is an exploded view of an alternative exemplary embodiment of a "flip notch" rear sight. Similarly to the embodiment shown in FIG. 25A, the configuration shown in FIG. 25B does not require ball and spring components. Rather, the ball plunger 284 is configured to pass through the threaded hole 270, and to thereby communicate with openings (e.g., recessed openings) or dimples 482 on the flipping element. In this manner, the plunger 284 communicates with one of the dimples 482 on the surface of the flipping element, which surface in turn mates with the surface of the blade supporting member 244. The two small openings or dimples 482 on the surface (not shown) of the flipping element that mates against the surface of the blade supporting member 244 (shown in FIG. 19, for example), are configured to communicate with the flipping element, so as to receive it and securely position the flipping element either in the first or second position. The dimples may be similar and/or analogous to the detents 182' and 182" shown in FIG. 15B, for example. That is, the dimples may be formed as small diameter spherical holes with a conical base portion (e.g., as spherical basins including bowl-shaped depressions).

Figure 26A:
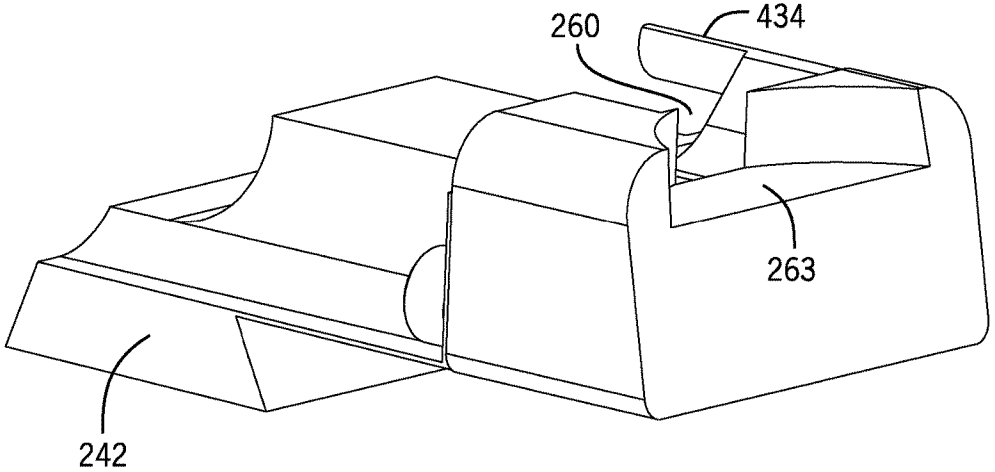
FIG. 26A is a front view of the "flip notch" rear sight of FIG. 25B when an arm thereof is in a first position.
Figure 26B:
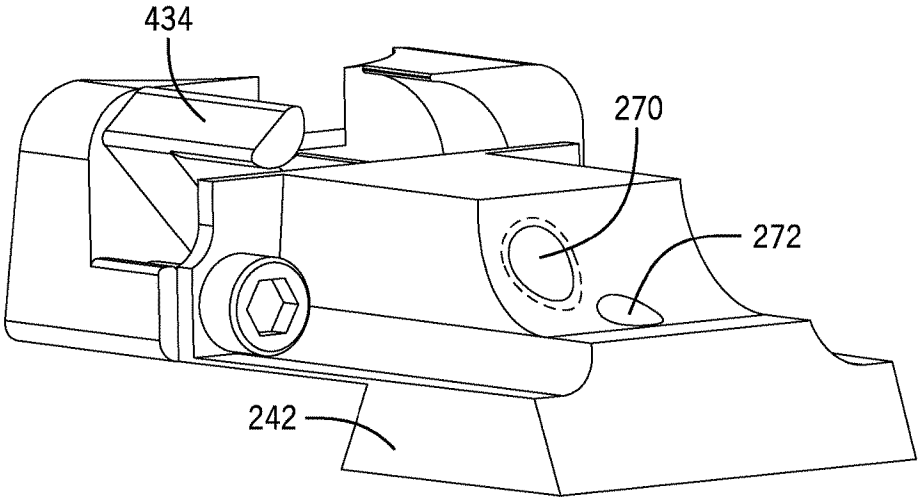
FIG. 26B is a rear view of the "flip notch" rear sight of FIG. 25B when an arm thereof is in the first position.
Figure 27A:
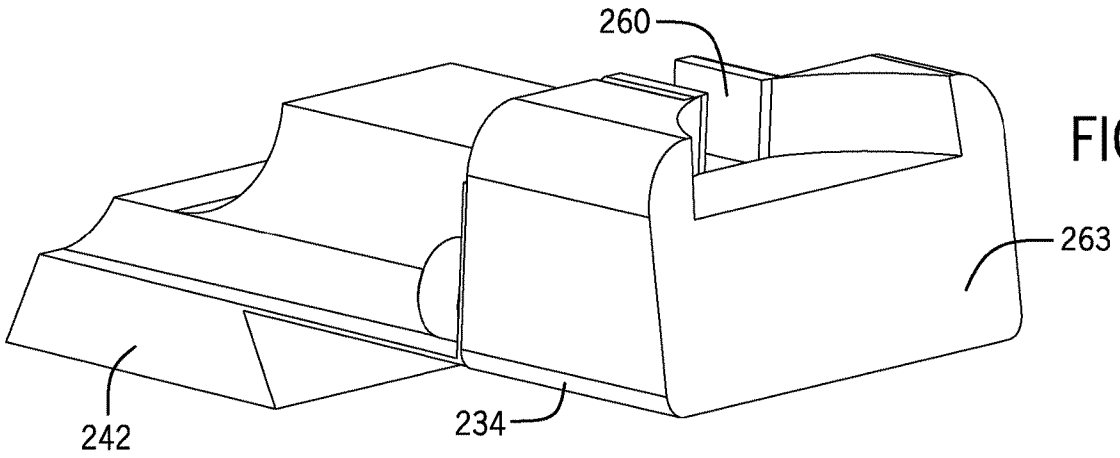
FIG. 27A is a front view of the "flip notch" rear sight of FIG. 25B when a flipping element is in a second position.
Figure 27B:
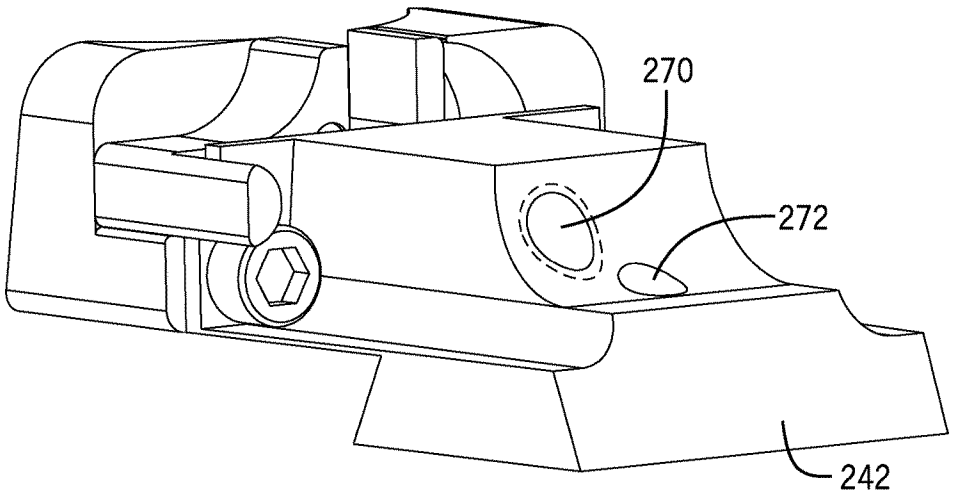
FIG. 27B is a rear view of the "flip notch" rear sight of FIG. 25B when a flipping element is in the second position.

The flipping element is further provided with an opening 432 that receives the cylindrical shaft 156 shown, for example, in FIGS. 14C and 15B. The flipping element is configured with a pivot notch arm 434 that is configured to move to a plurality of positions. FIG. 26A-B are front and rear views, respectively, of the "flip notch" rear sight of FIG. 25B when the flipping element thereof is in a first position. FIGS. 27A and B are front and rear views, respectively, of the "flip notch" rear sight of FIG. 25B when the flipping element is in a second position. In FIGS. 26A-B, the flipping element is in an 'up' position, so a smaller notch of the plurality of notches (e.g., notch 238) is down, and cannot be seen or used by the shooter. That is, the smaller notch does not serve as the effective sighting notch when the flipping element is in the 'up' position. In FIGS. 27A-B, the flipping element is in the 'down' position, so the smaller notch is in an 'up' position can be seen or used by the shooter, so as to serve as an effective sighting notch. Further, in some embodiments, the first sighting notch, such as notch 160 or 260, may be wider than the second sighting notch, such as notch 138 or 238. For example, in some embodiments, the first notch may be a wide sighting notch selected for a close open or partial target (i.e., 1 to 10 yards), while the second notch may be a medium sighting notch selected for an intermediate open or partial target (i.e., 10 to 25 yards). In some embodiments, the first notch may be a wide sighting notch selected for a close open or partial target (i.e., 1 to 10 yards), while the second notch may be a narrow sighting notch selected for a distant target (i.e., 25 to 50 yards). In some embodiments, the first notch may be a medium sighting notch selected for an intermediate open or partial target (i.e., 10 to 25 yards, while the second notch may be a narrow sighting notch selected for a distant target (i.e., 25 to 50 yards). A width for a wide sighting notch may be, for example, between 0.140 in and 0.170 in or between 0.150 in and 0.155 in or any subrange within these ranges. A width for a medium sighting notch may be, for example, between 0.120 in and 0.140 in or between 0.125 in. and 0.130 in or any subrange within these ranges. A width for a narrow sighting notch may be, for example, between 0.085 in. and 0.115 in or between 0.090 in. and 0.100 in or any subrange within these ranges.

Rear sights, such as rear sights 130 and 230, may allow a shooter to quickly and easily change the aspects of the rear sight sighting notch, including the width of the notch, the depth of the notch, and/or the shape of the notch.

Rear sights, such as rear sights 130 and 230, may, for example, be used by a shooting student (e.g., a law enforcement officer, military personnel, recreational shooters, etc.). As the shooting student is learning and advancing in their skill development, having the ability to quickly change from the first sighting notch to the second sighting notch and back during a training session expedites the training curve, reduces the training time and gives the shooter flexibility in learning to shoot and in training. As the shooter progresses, he or she can select the sighting notch size to go along with their skills or the drills being shot. Further, depending on the shooter's own personal learning style, perception and personal shooting nuances, having the ability to quickly change from one notch to another makes more efficient use of the training time and enhances the actual training received.

Once someone has learned to shoot, they can select a sighting notch that might potentially be beneficial to potential scenarios that might be presented.

Rear sights, such as rear sights 130 and 230, may also be beneficial for a competitive shooter.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., movable, removable, or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the rear sight as shown in the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method of steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A rear sight for use on a firearm, the rear sight comprising:

a rear sight blade connected to a mounting base, wherein the mounting base is configured to be connected to a top surface of the firearm; and a notched member configured to move relative to the blade, the notched member comprising a disc, wherein the blade includes a sighting notch positioned to be aligned with a post on a front sight;

wherein the width of the sighting notch is variable, and wherein the disc has a plurality of positioning holes formed therein and spaced radially around a rotational axis of the disc, and an air bleed opening is provided in a base of each of the plurality of positioning holes.

2. The rear sight of claim 1, wherein the notched member includes a plurality of notches and can be moved so that only one of the plurality of notches is visible to a user of the firearm.

3. The rear sight of claim 2, wherein the disc is configured to be rotated within the blade so that one of the plurality of notches is positioned to be visible to the user and forms the sighting notch.

4. The rear sight of claim 2, wherein one of the blade or mounting base include alignment features that are positioned so that the notched member is fixed in one of a plurality of positions corresponding to the positioning of one of the plurality of notches within the blade notch.

5. The rear sight of claim 4, wherein the alignment features comprises detents in a surface of the blade facing the notched member, wherein the rear sight further comprises a ball bearing movable relative to the notched member and the blade and configured to be located in one of the detents, and a spring for biasing the ball bearing away from the notched member and toward the blade, and wherein the air bleed opening provided in a base of at least one positioning hole of the plurality of positioning holes is structured such that air within the at least one positioning hole escapes when the ball bearing is forced from the one of the detents into the at least one positioning hole.

6. The rear sight of claim 2, wherein the blade includes a first pair of curved surfaces on opposing sides of the blade notch.

7. The rear sight of claim 1, wherein the mounting base includes an arm that is moveable relative to the top surface of the firearm so that the vertical position of the rear sight blade can be varied.

8. The rear sight of claim 7, wherein the notched member is biased toward either the blade or the mounting base.

9. The rear sight of claim 1, wherein the mounting base includes a blade supporting member that is moveable relative to the top surface of the firearm so that the horizontal position of the rear sight member can be varied.

10. A firearm comprising:

a fixed front sight including a post;

a rear sight located closer to the user than the front sight, the rear sight including a rear sight notch; and a notched member comprising a disc and configured to move relative to a blade provided in the rear sight;

wherein the sights are positioned so that when aiming the firearm the user can align the firearm so that from the perspective of the user, the post is positioned within the rear sight notch;

wherein the width of the rear sight notch is variable, and wherein the disc has a plurality of positioning holes formed therein and spaced radially around a rotational axis of the disc, and an air bleed opening is provided in a base of each of the plurality of positioning holes.

11. The firearm of claim 10, wherein the blade is connected to a mounting base, wherein the mounting base is configured to be connected to a top surface of the firearm, and wherein the rear sight notch is formed in the blade.

12. The firearm of claim 11, wherein the notched member includes a plurality of notches and can be moved so that only one of the plurality of notches is visible to the user of the firearm.

13. A method of varying a width of a sighting notch, which comprises a rear sight of a handgun, the method comprising:

selecting a desired width of a sighting notch, which comprises a rear sight of a handgun; and rotating a disc integrated into the rear sight and having a plurality of sighting notches to expose a sighting notch having the desired width or refraining from rotating the disc if the sighting notch having the desired width is already exposed, wherein the disc has a plurality of positioning holes formed therein and spaced radially around a rotational axis of the disc, and an air bleed opening is provided in a base of each of the plurality of positioning holes.

14. The method of claim 13, in which the plurality of sighting notches includes at least three notches differing in width.

* * * * *